US011022153B2

(12) United States Patent
Green et al.

(10) Patent No.: US 11,022,153 B2
(45) Date of Patent: Jun. 1, 2021

(54) HYDRAULIC APPARATUS COMPRISING SYNTHETICALLY COMMUTATED MACHINE, AND OPERATING METHOD

(71) Applicant: ARTEMIS INTELLIGENT POWER LIMITED, Midlothian (GB)

(72) Inventors: Matthew Green, Midlothian (GB); Uwe Stein, Midlothian (GB)

(73) Assignee: ARTEMIS INTELLIGENT POWER LIMITED, Midlothian (GB)

( * ) Notice: Subject to any disclaimer, the term of this patent is extended or adjusted under 35 U.S.C. 154(b) by 59 days.

(21) Appl. No.: 16/069,632

(22) PCT Filed: Jan. 13, 2017

(86) PCT No.: PCT/GB2017/050084
§ 371 (c)(1),
(2) Date: Jul. 12, 2018

(87) PCT Pub. No.: WO2017/122024
PCT Pub. Date: Jul. 20, 2017

(65) Prior Publication Data

US 2019/0010965 A1 Jan. 10, 2019

(30) Foreign Application Priority Data

Jan. 15, 2016 (GB) ..... 1600819

(51) Int. Cl.
*F15B 11/044* (2006.01)
*F04B 49/08* (2006.01)
(Continued)

(52) U.S. Cl.
CPC ..... *F15B 11/044* (2013.01); *E02F 9/22* (2013.01); *E02F 9/2246* (2013.01); *F04B 1/04* (2013.01);
(Continued)

(58) Field of Classification Search
CPC ..... E02F 9/2232; E02F 9/2235; F04B 7/0076; F04B 49/22; F04B 49/225
See application file for complete search history.

(56) References Cited

U.S. PATENT DOCUMENTS 3,779,673 A * 12/1973 Ahern ..... F03C 2/08 418/61.1
4,024,710 A 5/1977 Zelle
(Continued)

FOREIGN PATENT DOCUMENTS

CN 1488858 A 4/2004
CN 103403361 A 11/2013
(Continued)

OTHER PUBLICATIONS

Search Report dated Mar. 15, 2016 from corresponding application No. GB1600819.5.
(Continued)

*Primary Examiner* — Abiy Teka
*Assistant Examiner* — Matthew Wiblin
(74) *Attorney, Agent, or Firm* — Hauptman Ham, LLP

(57) ABSTRACT

An apparatus comprising a synthetically commutated machine with one or more services, a prime mover coupled to the machine, a hydraulic circuit extending between the services and hydraulic loads to fluidically connect the services to the hydraulic loads such that groups of one or more services are fluidically connected to respective groups of one or more hydraulic loads. The apparatus configured such that the flow of hydraulic fluid to or from a group of services of the machine is controlled responsive to measuring a flow rate and/or pressure requirement of the hydraulic loads which are fluidically connected to the services, or receiving a demand signal indicative of a demanded pressure and/or flow rate based on a pressure and/or flow demand of
(Continued)

hydraulic loads which are fluidically connected to the services.

18 Claims, 23 Drawing Sheets

(51) Int. Cl.

| | |
|---|---|
| ***F04B 1/12*** | (2020.01) |
| ***F04B 1/04*** | (2020.01) |
| ***F04B 1/06*** | (2020.01) |
| ***F04B 1/16*** | (2006.01) |
| ***E02F 9/22*** | (2006.01) |
| ***F04B 49/20*** | (2006.01) |
| ***F04B 49/22*** | (2006.01) |
| ***F15B 11/042*** | (2006.01) |
| ***F15B 11/17*** | (2006.01) |

(52) U.S. Cl.

CPC ..... *F04B 1/06* (2013.01); *F04B 1/12* (2013.01); *F04B 1/16* (2013.01); *F04B 49/08* (2013.01); *F04B 49/20* (2013.01); *F04B 49/22* (2013.01); *F15B 11/042* (2013.01); *F15B 11/17* (2013.01); *E02F 9/2292* (2013.01); *E02F 9/2296* (2013.01); *F15B 2211/20546* (2013.01); *F15B 2211/20569* (2013.01); *F15B 2211/20576* (2013.01); *F15B 2211/251* (2013.01); *F15B 2211/252* (2013.01); *F15B 2211/253* (2013.01); *F15B 2211/2654* (2013.01); *F15B 2211/275* (2013.01); *F15B 2211/455* (2013.01); *F15B 2211/46* (2013.01); *F15B 2211/632* (2013.01); *F15B 2211/6651* (2013.01); *F15B 2211/6652* (2013.01); *F15B 2211/6653* (2013.01); *F15B 2211/6654* (2013.01); *F15B 2211/7052* (2013.01); *F15B 2211/71* (2013.01); *F15B 2211/75* (2013.01); *F15B 2211/781* (2013.01)

(56) References Cited

U.S. PATENT DOCUMENTS

| | | | | |
|---|---|---|---|---|
| 4,507,057 | A | 3/1985 | Igarashi et al. | |
| 4,712,376 | A | 12/1987 | Hadank et al. | |
| 5,190,446 | A | 3/1993 | Salter et al. | |
| 5,259,738 | A | 11/1993 | Salter et al. | |
| 5,944,492 | A | 8/1999 | Konishi et al. | |
| 6,244,831 | B1 | 6/2001 | Kawabata et al. | |
| 8,192,175 | B2 * | 6/2012 | Kuttler | F04B 49/22 417/290 |
| 8,347,621 | B2 * | 1/2013 | Rampen | F04B 17/05 60/468 |
| 8,348,627 | B2 * | 1/2013 | Rampen | F04B 49/243 417/57 |
| 2009/0113888 | A1 | 5/2009 | Kuttler et al. | |
| 2009/0123313 | A1 * | 5/2009 | Armstrong | F04C 14/24 418/1 |
| 2010/0037604 | A1 | 2/2010 | Rampen et al. | |
| 2010/0322791 | A1 * | 12/2010 | Wadsley | F04B 1/28 417/286 |
| 2013/0009612 | A1 * | 1/2013 | Caldwell | F03D 15/00 322/40 |
| 2013/0189118 | A1 | 7/2013 | Cochran et al. | |
| 2013/0257049 | A1 * | 10/2013 | Taylor | F03D 9/255 290/43 |
| 2013/0318971 | A1 | 12/2013 | Sora | |
| 2014/0241902 | A1 | 8/2014 | Wu et al. | |
| 2014/0260232 | A1 | 9/2014 | Danzl et al. | |
| 2016/0123311 | A1 | 5/2016 | Dole et al. | |
| 2016/0208898 | A1 * | 7/2016 | Caldwell | F04B 11/00 |
| 2016/0356160 | A1 | 12/2016 | Dole et al. | |
| 2016/0376770 | A1 | 12/2016 | Matsuzaki et al. | |
| 2017/0009753 | A1 * | 1/2017 | Pfaff | F04B 1/04 |
| 2017/0284388 | A1 * | 10/2017 | Caldwell | F15B 11/0426 |
| 2018/0163374 | A1 * | 6/2018 | Imura | E02F 9/2066 |
| 2018/0245609 | A1 * | 8/2018 | Caldwell | F04B 49/06 |
| 2019/0010965 | A1 * | 1/2019 | Green | E02F 9/2246 |

FOREIGN PATENT DOCUMENTS

| | | |
|---|---|---|
| EP | 0 361 927 | 4/1990 |
| EP | 0851122 | 7/1998 |
| EP | 2677146 | 12/2013 |
| EP | 2 851 562 | 3/2015 |
| GB | 2068889 | 8/1981 |
| JP | S5336004 | 4/1978 |
| JP | S5336005 | 4/1978 |
| JP | S58106203 | 6/1983 |
| JP | S61182475 | 8/1986 |
| JP | H01501241 | 4/1989 |
| JP | H04501294 | 3/1992 |
| JP | H04203502 | 7/1992 |
| JP | H05503335 | 6/1993 |
| JP | H07190004 | 7/1995 |
| JP | 2000309948 | 11/2000 |
| JP | 2004324742 | 11/2004 |
| JP | 2009275771 | 11/2009 |
| JP | 2013023821 | 2/2013 |
| JP | 2013072367 | 4/2013 |
| JP | 2014190514 | 10/2014 |
| WO | 8803285 | 5/1988 |
| WO | 9003519 | 4/1990 |
| WO | WO 91/05163 | 4/1991 |
| WO | WO 2010/089518 | 8/2010 |
| WO | 2011104543 | 9/2011 |
| WO | WO 2014/202344 | 12/2014 |
| WO | 2015012340 | 1/2015 |

OTHER PUBLICATIONS

International Search Report and Written Opinion dated May 8, 2017 from corresponding application No. PCT/GB2017/050084.

"Industrial system with synthetically commutated variable displacement fluid working machine," IP.com publication identifier IPCOM000239042D, pp. 1-61.

* cited by examiner

HYDRAULIC APPARATUS COMPRISING SYNTHETICALLY COMMUTATED MACHINE, AND OPERATING METHOD

RELATED APPLICATIONS

The present application is a National Phase of International Application Number PCT/GB2017/050084, filed Jan. 13, 2017, and claims the priority of Great Britain Application No. 1600819.5, filed Jan. 15, 2016, the disclosure of which is incorporated herein by reference.

TECHNICAL FIELD

The invention relates to hydraulic apparatus such as industrial vehicles (e.g. excavators) and other mobile apparatus with multiple hydraulically powered loads.

BACKGROUND

Industrial vehicles with multiple hydraulically powered actuators are in common use around the world. For example, excavators typically have at least two hydraulically powered tracks for movement, a rotary actuator (e.g. a motor) for rotating the cab of the excavator relative to a base which comprises the tracks, rams for controlling movement of an excavator arm including at least one ram for the boom, and at least one for the stick (arm), and at least two actuators for controlling movement of a bucket or other tool.

The invention seeks to provide improved hydraulic control systems for controlling multiple hydraulically powered actuators and other hydraulic loads. Some aspects of the invention seek to provide hydraulic control systems which have advantages of energy efficiency. Advantageously, implementing the improved hydraulic control systems means energy provided by the prime mover is used more efficiently to perform work functions, thus providing fuel savings.

SUMMARY

According to a first aspect of the invention there is provided apparatus comprising a synthetically commutated machine with one or more services, a prime mover coupled to the machine, a hydraulic circuit extending between the one or more (typically two or more) services and the plurality of hydraulic loads to thereby fluidically connect the one or more (typically two or more) services to the plurality of hydraulic loads such that groups of one or more services are fluidically connected to respective groups of one or more hydraulic loads, the apparatus configured such that the flow of hydraulic fluid to or from a group of one or more services of the machine is controlled responsive to receiving a demand signal indicative of a demanded pressure and/or flow rate (typically based on a pressure and/or flow demand of the group of one or more hydraulic loads which are fluidically connected to the group of one or more services).

The invention also extends to a method of operating the said apparatus, comprising detecting the flow and/or pressure requirement of at least one of the group of hydraulic loads, or receiving a demand signal indicative of a demanded pressure or flow based on a pressure and/or flow demand of the group of one or more hydraulic loads, and controlling the flow of hydraulic fluid from or to each of the group of one or more services which is fluidically connected to the group of one or more hydraulic loads, responsive thereto.

By a service we refer to an independent output from the machine of, or input to the machine of, hydraulic fluid to or from one or more hydraulic loads. Services typically comprise a port through which hydraulic fluid flows in use. Typically, a service connection is provided on the (relatively) high pressure side of the hydraulic machine (the high pressure side being the output, if the machine is functioning as a pump and the high pressure side being the input, if the machine is functioning as a motor). The machine typically comprises a plurality of working chambers (e.g. cylinders, within which pistons reciprocate in use) and each is associated with (e.g. connected to) a service, each service being associated with (e.g. connected to) a group of one or more of the working chambers. One or more high pressure lines may connect one or more working chambers to one or more services. One or more low pressure lines may connect one or more working chambers to one or more services (or simply to a low pressure fluid reservoir, for example). For example, if the machine has 12 working chambers, the flow from or to each chamber may be commoned to provide a single service, or they may be connected as 3 services of 4 working chamber each; 2 services of 6 working chambers; or 1 service of 6 working chambers and 2 services of 3 working chambers etc. Flow to and from working chambers can be joined by ports in the casing or body of the machine and/or end plate, to connect the flow to or from respective working chambers. Working chambers may be dynamically allocated to services to thereby change which one or more working chambers are connected to a service, for example by opening or closing electronically controlled valves under the control of a controller. Hydraulic loads may be dynamically allocated to services to thereby change which working chambers of the machine are coupled to which hydraulic loads, for example by opening or closing electronically controlled valves under the control of a controller. The net displacement of working fluid through each service can be regulated by regulating the net displacement of the working chamber or chambers which are connected to the service. This regulation can be through opening or closing the electronically connected valves. The net displacement will additionally be determined by having separate or merged hydraulic lines from respective working chambers determining which one or more working chambers are connected with which one or more services. These connections between working chambers may be permanently set at the point of establishing the hydraulic circuit, or can be changed at any given time according to the set position of possible ganging valves.

It may be that each service is connected to one hydraulic load, but it may be that a service is fluidically connected to one or more hydraulic loads. Similarly, a hydraulic load may be fluidically connected to one or more services. Thus one or more services are connected together to one or more hydraulic loads. In general, one or more groups of one or more services are each connected to a respective group of one or more hydraulic loads. Typically each service is fluidically connected to at least one hydraulic load and each hydraulic load is fluidically connected to at least one service. The hydraulic circuit may comprise a plurality of discrete portions. The hydraulic circuit may comprise one or more valves which are actuatable under the control of a controller to change which one or more services are connected to which one or more hydraulic loads. The hydraulic circuit may comprise one or more hydraulic control circuits. The hydraulic control circuits may comprise flow sensors. Where a group of one or more services fluidically connected to a group of one or more hydraulic loads is referred to herein, it may be that the group of one or more services is a subset of all of the services of the machine and the group of one or more hydraulic loads is a subset of all of the hydraulic loads which are fluidically connected to at least one service of the machine.

By a hydraulic load we refer to an actuator which can be driven by a supply of hydraulic fluid. The supply of hydraulic fluid to the actuator does work. The hydraulic loads can therefore act as sinks (also known as consumers) of hydraulic fluid. Typically some or all of the hydraulic loads may also supply hydraulic fluid back to one or more services. Work may be done on the actuators to pressurise hydraulic fluid and thereby typically drive it back to one or more services of the machine. Thus, some or all of the hydraulic loads are typically also operable as sources of hydraulic fluid. Examples of hydraulic loads are rams, hydraulic motors, and other such hydraulic actuators, suitable for excavator arms, arm segments, rotating cabs of excavators etc.

By a synthetically commutated machine we refer to a hydraulic fluid working machine comprising a rotatable shaft, one or more working chambers (e.g. chambers defined by cylinders, within which pistons reciprocate in use) having a volume which varies cyclically with rotation of the rotatable shaft, each working chamber having a low pressure valve which regulates the flow of hydraulic fluid between the working chamber and a low pressure line and a high pressure valve which regulates the flow of hydraulic fluid between the working chamber and a high pressure line. The low pressure line may extend to one or more services. The high pressure line may extend to one or more services. It may be that at least the low pressure valves (and in some embodiments also the high pressure valves) are electronically controlled valves, and the apparatus comprises a controller which controls the electronically controlled valves in phased relationship with cycles of working chamber volume to thereby determine the net displacement of hydraulic fluid by each working chamber on each cycle of working chamber volume. The apparatus typically comprises a controller. The controller comprises one or more processors in electronic communication with memory, and program code stored on the memory. The controller may be distributed and may for example comprise a machine controller (comprising one or more processors in electronic communication with memory, and program code stored on the memory) which controls the machine and an apparatus controller (comprising one or more processors in electronic communication with memory, and program code stored on the memory) which controls the machine and other components of the apparatus (for example valves to change the flow path of hydraulic fluid). The prime mover is typically in driving engagement with the synthetically commutated machine. Typically the prime mover is coupled to the rotatable shaft of the synthetically commutated machine. Typically the prime mover has a rotatable shaft which is coupled to the rotatable shaft of the synthetically commutated machine (and in which the prime mover can generate torque). In some embodiments, the prime mover and the synthetically commutated machine have a common shaft.

The flow rate and/or pressure requirement of a group of one or more hydraulic loads may be determined by measuring the flow rate of hydraulic fluid to or from the group of one or more hydraulic loads, or the pressure of hydraulic fluid in or at an output or inlet of the one or more hydraulic loads, for example. The flow rate and/or pressure requirement may be determined from one or more measured flow rates and/or measured pressures decreasing or being below an expected value. A decrease in flow rate and/or measured pressure from an expected value indicates that insufficient flow or pressure to or from the group of one or more hydraulic loads is taking place. For example, it may be determined that the rate of flow of hydraulic fluid to an actuator is below an expected (target) value and providing a greater flow rate of hydraulic fluid to the actuator in response thereto. It may be determined that the rate of flow of hydraulic fluid from an actuator is above an expected (target) value (for example, as an arm or other weight is lowered) and reducing the flow rate from the actuator responsive thereto. It may be that a pressure increase or decrease is detected at one or more hydraulic loads and the group of one or more services connected to the one or more hydraulic loads are controlled to change (e.g. increase or decrease) the rate of flow of fluid from the group of one or more services to the one or more hydraulic loads, or vice versa.

The demand signal indicative of a demanded pressure or flow based on a pressure and/or flow demand of the hydraulic load may be a signal representing an amount of flow of hydraulic fluid, or pressure of hydraulic fluid, or the torque on the shaft of the machine or the shaft of a hydraulic load driven by the machine, or the power output of the machine or any other signal indicative of a demand related to the pressure or flow requirements of one or more hydraulic loads. The demand signal may comprise a digital or analogue signal communicated through one or more conductors.

The synthetically commutated machine may be operable as a pump. The synthetically commutated machine may be operable as motor. The synthetically commutated machine may be operable as a pump or a motor in alternative operating modes. It may be that some of the working chambers of the synthetically commutated machine may pump (and so some services may output hydraulic fluid) while other working chambers of the synthetically commutated machine may motor (and so some services may input hydraulic fluid). Thus, the synthetically commutated machine may be a pump, or a motor, or machine which is operable as a pump or a motor (a pump-motor).

It may be that the synthetically commutated machine is operable as a pump and wherein the output pressure of each of the groups of one or more services is controlled by sensing the individual pressure requirements of a group of one or more hydraulic loads fluidically connected to the respective group of one or more services and controlling the rate of flow of hydraulic fluid out of the respective one or more services so that the output pressure at least matches the maximum demanded pressure of the one or more hydraulic loads fluidically connected thereto.

Thus, the machine can ensure that hydraulic load or loads connected to a group of one or more services receive at least sufficient hydraulic fluid to maintain their input pressure at at least a required level. It may be sensed that insufficient pressure is provided if the pressure at the input to a hydraulic load drops below a threshold. The required level is sufficient to enable the hydraulic loads to fulfil their demands. This feature is especially useful in such circumstances and can enable minimisation of the number of additional valves required.

It may be that the synthetically commutated machine is operable as a pump and wherein the output pressure of a group of one or more services of the machine is maintained at a set pressure based on a user selectable mode. There may be pressure feedback to a controller of the synthetically commutated machine which is operating in a closed loop pressure control mode. The said controller may be configured (e.g. programmed) to set the flow rate of hydraulic fluid by the group of one or more services to match the total demand for flow of hydraulic fluid by the group of one or more hydraulic loads connected to the one or more services, by sensing the output pressure of the one or more services.

It may be that the output flow of a group of one or more services of the machine is controlled by detecting the flow demand of all hydraulic loads fluidically connected to the respective one or more services.

Flow demand may, for example be determined by detecting the pressure drop (using pressure sensors) across an orifice arranged such that the flow through the orifice reduces when the total flow demand of all hydraulic loads increases, or by direct flow measurement of the same flow using a flow sensing means such as a flowmeter.

Flow and/or pressure demand may be sensed by measuring the pressure of hydraulic fluid at an input of a hydraulic load. Where a hydraulic load is a hydraulic machine, flow demand may be sensed by measuring the speed of rotation of a rotating shaft or speed of translation of a ram or angular velocity of a joint, for example. The sum of the measured pressures or flows may be summed or the maximum of the measured pressures or flows found.

It may be that the pressure of or rate of flow of hydraulic fluid accepted by, or output by each service is independently controllable.

It may be that the pressure of, or rate of flow of hydraulic fluid accepted by, or produced by each service can be independently controlled by selecting the net displacement of hydraulic fluid by each working chamber on each cycle of working chamber volume. The selection is typically carried out by a controller.

The apparatus may be configured to selectively connect the input or output (as appropriate) of two or more of the services. This allows a selective increase in the effective capacity of the services. It may be that each of the services may be selectively connected to at least one other service. There may be a service, which is operable as a pump or a motor, which may be selectively ganged with one or more other services to increase the effective capacity of that other services, either boosting another pump service or boosting another motor service. By a pump service we mean a service through which fluid is pumped and by a motor service we mean a service through which fluid is received (to thereby provide power for working chambers to motor). A service operable as a pump or motor may be operated with a net flow of fluid in either direction, typically under the control of the controller. In some embodiments, the apparatus comprises a hydraulic machine (such as a standalone pump, motor or machine operable as a pump or motor) which is driven by a separate prime mover and which has an output or input which can be selectively connected with one or more of the said services. This is another way of selectively increasing the effective capacity of one or more of the services.

The apparatus may comprise a service, which is operable as a pump (service) or a motor (service), which may be selectively ganged with one or more other services to increase the effective capacity of that other service, either boosting another pump service or boosting another motor service.

The hydraulic apparatus may comprise a plurality of synthetically commutated machines according to an aspect of the present invention, wherein two or more said machines have rotating shafts which are coupled (for example, are the same shaft) and/or are located in the same container. The two or more said machines effectively becoming a single synthetically commutated machine with single or multiple services. The flow rate and/or pressure at each service is controlled by detection of the flow and/or pressure demand of the connected hydraulic loads, which may be individual hydraulic loads or groups of hydraulic loads. The connection of hydraulic loads to individual services may be dynamically altered.

FIGS. 28 to 33 show the sensing of flow or pressure requirement of individual groups of loads. In FIG. 28, Valve block A (330), and Valve block B (332) have dashed lines from the controller to each 'Valve block', indicating a pressure or flow feedback, and have one or more (three as illustrated) hydraulic loads fluidly connected to each valve block.

Valve block 298 in FIG. 7 may comprise separate valve blocks A/B/C/D (330, 332, 334, 336).

The apparatus may comprise a controller which controls the machine and optionally also one or more additional synthetically controlled machines driven by the same prime mover. The controller may be configured to calculate the available power from the prime mover and to limit the net displacement of hydraulic fluid by the one or more machines driven by the prime mover, such that the net power demand of the machines does not exceed that available from the prime mover. This may take into account the measured pressure of each service of each machine, the known (e.g. measured or controlled) displacement of each service of each machine (whether outflow or inflow) and the known efficiency of pumping or motoring of each machine.

The controller comprises one or more processors and a memory storing program code executed by the controller in operation. The controller may calculate a power limit value or a value related thereto, e.g. a maximum torque, pressure etc. The controller may calculate one or more output limit parameters of the machine responsive thereto. This may include the step of calculating or allowing for some energy loss by the machine. The additional synthetically controlled machines are typically according to one of the synthetically controller machine described above.

The apparatus (e.g. the controller) may be configured to implement a maximum rate of flow of hydraulic fluid through or pressure at a group of one or more services such that another group of one or more services, and therefore the group of one or more hydraulic loads fluidically connected to the other group of one or more services, are prioritised over one or more other hydraulic loads without exceeding a total available power or selectable maximum power of the machine.

The maximum rate of flow of hydraulic fluid limit is typically implemented by the controller. The controller may calculate the maximum rate. The selectable maximum power may be a user selectable value. Thus, the controller may impose a maximum rate of flow of hydraulic fluid limit to one or more hydraulic loads, through one or more services, while prioritising one or more other hydraulic loads, without exceeding a user selectable maximum power, which may be received through a user interface. The prioritisation of one or more services/hydraulic loads over one or more other services/hydraulic loads while a total available power or a selectable threshold power is not exceeded may be implemented by the controller selecting the net displacement of hydraulic fluid by individual working chambers of the machine, optionally on each cycle of working chamber volume.

It may be that a group of one or more services of the machine is in fluidic communication with a group of one or more loads and also at least one drain with a flow meter configured to measure the flow of hydraulic fluid to the drain. It may be that the rate of flow of hydraulic fluid output by the group of one or more services of the machine is controlled to exceed the measured rate of flow of hydraulic fluid from that group of loads to the drain (option 1), or the rate of flow of hydraulic fluid out of the group of one or more services is controlled responsive to the flow measured by the flow meter (option 2) to minimise the flow of hydraulic fluid to the drain (e.g. while continuing to provide a pressure of hydraulic fluid exceeding the said maximum, or while continuing to provide a required flow rate or pressure of hydraulic fluid to the group of one or more loads). In both cases it may be that the highest pressure of hydraulic fluid at any of the group of one or more loads is sensed and used to determine the pressure of hydraulic fluid at the output of the one or more services.

It may be that the synthetically commutated machine controller controls the prime mover (through a control interface of the prime mover) with reference to an engine map (e.g. engine efficiency map) to thereby increase (preferably optimise) the energy efficiency with which the demands of the hydraulic loads for pressure and flow of hydraulic fluid are met, and/or to thereby reduce the average and/or maximum operating speed of the prime mover.

The energy efficiency map comprises data stored on a memory, the data relating a parameter relating to energy efficiency (e.g. energy efficiency or fuel consumption) versus one or more operating variables of the prime mover (e.g. torque, speed of rotation of rotatable shaft etc.) The apparatus may be controlled such that when a prime mover power limit is reached (or it is predicted that this might happen), the apparatus is configured to control an additional power source, other than the prime mover, to obtain additional energy from the additional power source to drive the synthetically commutated machine.

The additional power source may for example, be a battery in electrical communication with an electrical motor which is coupled to the synthetically commutated machine. The additional power source may be another said synthetically commutated machine. The additional power source may comprise a rotatable shaft coupled to (for example being an extension of) the rotatable shaft of the synthetically commutated machine wherein the additional power source generates power by applying a torque to the rotatable shaft of the additional power source and thereby also the rotatable shaft of the synthetically commutated machine.

The apparatus may comprise a controller. The controller may be configured to selectively cause a flow of hydraulic fluid to a group of one or more hydraulic loads from a hydraulic fluid store (typically a container for pressurised hydraulic fluid, such as in an accumulator), and to selectively cause hydraulic liquid from a group of one or more hydraulic loads to flow to said hydraulic fluid store for later use. The controller may also be configured to adjust the displacement of the machine such that the sensed pressure and/or flow demand of the group of one or more hydraulic loads is met wholly by the flow of hydraulic fluid from the hydraulic fluid store, or by a combination of the flow of hydraulic fluid from the hydraulic fluid store and the group of one or more services of the machine which are fluidically connected to the group of one or more hydraulic loads, or wholly by the group of one or more services of the machine which are fluidically connected to the group of one or more hydraulic loads. Typically, in the case where the flow to a hydraulic load is supplied wholly or partly from the hydraulic fluid store, the controller may be configured (e.g. programmed) to control the prime mover to limit the power output of the prime mover.

This avoids the power limit of the prime mover being exceeded. The use of stored and returned pressurised fluid may also enable a lower power prime mover to be employed and/or be more energy efficient.

The apparatus may comprise a hydraulic fluid store (typically a container for pressurised hydraulic fluid, such as an accumulator). The apparatus may be configured to selectively introduce hydraulic liquid from the hydraulic fluid store to a group of one or more services and/or a group of one or more hydraulic loads, to thereby drive the machine and/or a group of one or more hydraulic loads, and to selectively receive hydraulic liquid from a group of one or more services and/or a group of one or more hydraulic loads into the hydraulic fluid store, and further to receive hydraulic fluid from the hydraulic fluid store to a first group of one or more services while a second group of one or more different services outputs fluid to a group of one or more hydraulic loads.

Thus, one or more services receive fluid from the hydraulic fluid store (with the corresponding one or more working chambers carrying out motoring cycles), thereby driving the machine (applying torque to the rotatable shaft of the machine, where present), while one or more other services output fluid to one or more hydraulic loads (with the corresponding one or more working chambers carrying out pumping cycles). Thus, energy from the hydraulic fluid store can be used in part to drive the one or more hydraulic loads. This enables the size and/or power limit of the prime mover (e.g. an engine) to be lower than would otherwise be the case, increasing efficiency. The hydraulic fluid store is typically connected to (and selectively introduces hydraulic fluid into and/or receives hydraulic fluid from) the fluid connection extending between a group of one or more services and a group of one or more hydraulic loads.

The apparatus may comprise at least one second synthetically commutated machine coupled to the first said synthetically commutated machine (e.g. the machines may have coupled rotatable shafts), wherein the first said synthetically commutated machine is coupled to one or more sources of hydraulic fluid (typically a group of one or more hydraulic loads) through one or more services and the second synthetically commutated machine is coupled to a hydraulic fluid store (typically a container for pressurised hydraulic fluid, such as in an accumulator) such that the receipt of hydraulic fluid from the one or more sources by the first synthetically commutated machine causes the second synthetically commutated machine to pump hydraulic fluid into the hydraulic fluid store and/or the receipt of hydraulic fluid by the second synthetically commutated machine from the hydraulic fluid store causes the first synthetically commutated machine to pump hydraulic fluid through the one or more services (e.g. to said one or more sources, typically one or more hydraulic loads).

This has the advantage that the flow of hydraulic fluid from a source, or to a hydraulic load, can be used to pump hydraulic fluid into, or receive hydraulic fluid from a hydraulic fluid store (thereby storing and reusing energy) while isolating the hydraulic fluid store from the source and/or hydraulic load.

The apparatus may be configured to selectively charge an energy storage device (e.g. a flywheel) using energy from a flow of hydraulic fluid into a group of one or more services from a group of one or more hydraulic loads and to selectively pump hydraulic fluid from the group of one or more services to a group of one or more hydraulic loads from the energy storage device.

Typically, the one or more working chambers associated with the group of one or more services carrying out motoring cycles when the hydraulic fluid is received and carrying out pumping cycles when the hydraulic fluid is selectively pumped.

It may be that at least one hydraulic load is connected either directly to a said group of one or more services, with no additional flow control mechanism between the group of one or more services and the hydraulic load, (or optionally connected via a flow smoothing device only), such that the mean hydraulic flow rate to or from the group of one or more services is directly proportional to the displacement velocity of a displaceable member of the hydraulic load (e.g. a ram, an arm, a rotary actuator etc.). It may be that the flow to or from the service is controlled responsive to a signal indicating a demanded velocity of displacement of the displaceable member.

It may be that there is no flow control valve between the output of the machine and the hydraulic loads.

It may be that the group of one or more services is fluidically connected to a hydraulic load, the hydraulic load comprising an actuator having a displaceable member (e.g. a ram or a rotary actuator) which is displaced in use in dependence on the flow of hydraulic fluid with no additional flow control mechanism between the group of one or more services and the hydraulic load (optionally except a flow smoothing device) such that the volume of hydraulic fluid flowing from the group of one or more services to the hydraulic load or vice versa is directly proportional to the displacement of the displaceable member. It may be that the volume of hydraulic fluid flowing from the group of one or more services to the hydraulic load or vice versa is controlled responsive to a signal indicating a demanded displacement of the displaceable member and/or a signal indicating the measured displacement of the displaceable member.

The displaceable member may be displaced rotationally in use and the displacement of the displaceable member may be angular displacement.

BRIEF DESCRIPTION OF THE DRAWINGS

Example embodiments of the invention will now be illustrated with reference to the following Figures in which.

It should be recognised that hydraulic circuit schematics for practical designs of mobile and static hydraulic equipment, especially heavy construction equipment, are notoriously complex. For simplicity and clarity, the Figures omit features which one skilled in the art will appreciate may be present, such as commonplace pressure relief valves, drain lines, flow control, hydraulic load holding, hydraulic load cushioning, a stopping detail on the swing circuit to counter the self-swinging (caused by action of gravity when swinging on a slope), a brake on the swing circuit, amongst other aspects. All circuits could be modified to work with a double acting ram, by providing a controllable flow of hydraulic fluid to each end, however in the circuits show a single acting ram for simplicity.

DETAILED DESCRIPTION

It is worth noting that whilst any block containing a valve, may constitute a 'valve block', we use the phrase as is commonly understood in the construction equipment industry. Such valve block (labelled in FIG. 8) contains a number of closed centre valves, as depicted in later images 9-12, each of these valves is connected to one or more hydraulic loads.

The invention makes use of synthetically controlled machine, and pumps/motors/pumps-motors. Examples are described in EP 0 361 927, EP 0 494 236, and EP 1 537 333, GB 2477997, the contents of which are hereby incorporated by virtue of this reference. These machines have services in the form of connections from one or more cylinders to one or more hydraulic loads or sources. Machines with controllable connections from cylinders to hydraulic loads or sources are shown in WO 2014/202344 (Artemis/Danfoss), US20100037604 (Artemis/Danfoss), the contents of which are incorporated herein by virtue of this reference. These machines have a number of services in the form of port connections from the outer walls of the machine or end plates attached to the machine, connected to hydraulic conduits which extend to sources or sink of fluid. Machines with controllable connections from cylinders to hydraulic loads or sources are shown in WO 2014/202344 (Artemis/Danfoss), the contents of which are incorporated herein by virtue of this reference.

Example 1—Heavy Construction Equipment Hydraulic Circuit

In order to describe the invention we first describe, with references to FIGS. 1, 6, 7 and 25, the normal operation of heavy construction equipment with a hydraulic transmission, and we then discuss, with reference to the Figures, the modifications required to carry out the present invention.

Heavy Construction Equipment and Normal Operating Function

Figure 1:
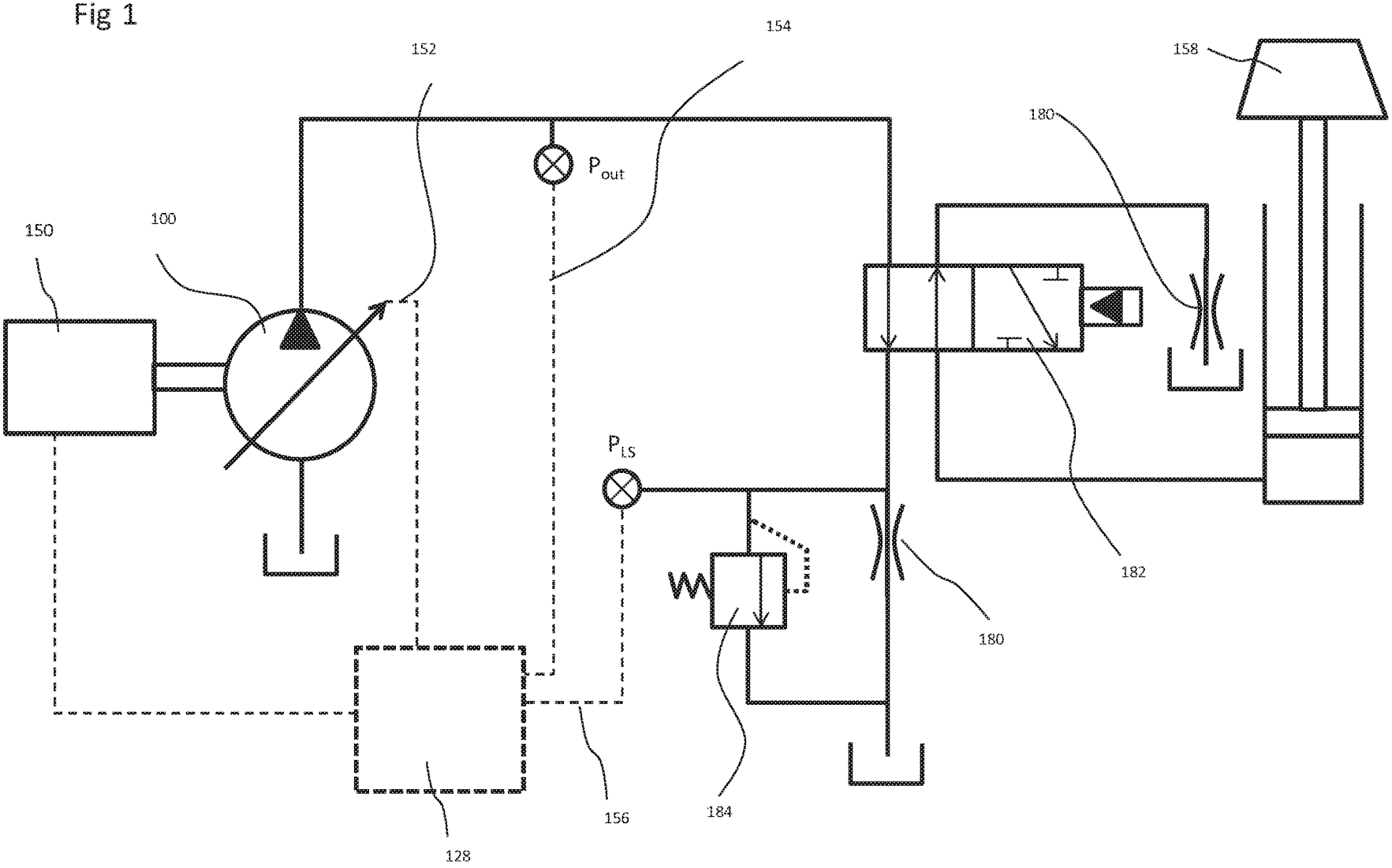
FIGS. 1 to 5 are hydraulic circuits from a heavy construction equipment machine incorporating one or more synthetically commutated machines (pump/motor/pump-motors)

With reference to FIG. 1, a heavy construction equipment (for example an excavator or other construction vehicle) incorporating a synthetically commutated pump. Typically, the pump transmits pressure and flow to a variety of work functions (e.g. boom ram, swing motor, track motors, jack hammer, pile driver), thus forming a hydraulic transmission. These work functions are examples of hydraulic loads.

Within the hydraulic transmission, oil, functioning as hydraulic fluid, is supplied from a tank to the input side of the synthetically commutated pump through low pressure hydraulic fluid line. Pressurised oil is delivered from a service acting as an output of the pump to the input side of the hydraulic ram through high pressure hydraulic fluid line. The pressure in the high pressure hydraulic fluid line is sensed using a pressure sensor $P_{out}$.

The heavy construction equipment includes a pump controller (or machine controller shown in FIG. 7), as well as a system controller (also shown in FIG. 7), the system controller controls the hydraulic transmission by sending control signals to the pump/machine controller, in order to regulate the respective displacement. This controller is known as the machine controller, or more specifically in FIG. 1 as the pump controller. The control signals (the displacement demand signals) demand displacement by the synthetically controlled machine or machines, expressed as a fraction of maximum displacement (the displacement demand). The absolute volume of the displacement (volume of hydraulic fluid per second) will be the product of the fraction of maximum displacement, the maximum volume which can be displaced per revolution of the rotatable shaft of the pump or motor and the rate of revolution of the rotatable shaft or motor (revolution per second). This way, the pump controller can regulate the torque applied through the drive shaft, which is proportional to the displacement (volume per second) of the hydraulic pump, and the pressure in the high pressure hydraulic fluid line. The machine controller can also regulate the energy or power provided to the hydraulic load, which depends on the displacement (volume per second) of the hydraulic pump, and the pressure in the high pressure hydraulic fluid line. The pressure in the high pressure hydraulic fluid line increases when the hydraulic pump displaces oil at a higher displacement (volume per second) than the intake of oil by the hydraulic load, and decreases when the hydraulic load intakes oil at a lower displacement (volume per second) than the hydraulic pump. In alternative embodiments a plurality of hydraulic pumps and/or a plurality of hydraulic loads are in fluid communication with the high pressure fluid line and so the displacement of each must be considered.

Figure 6:
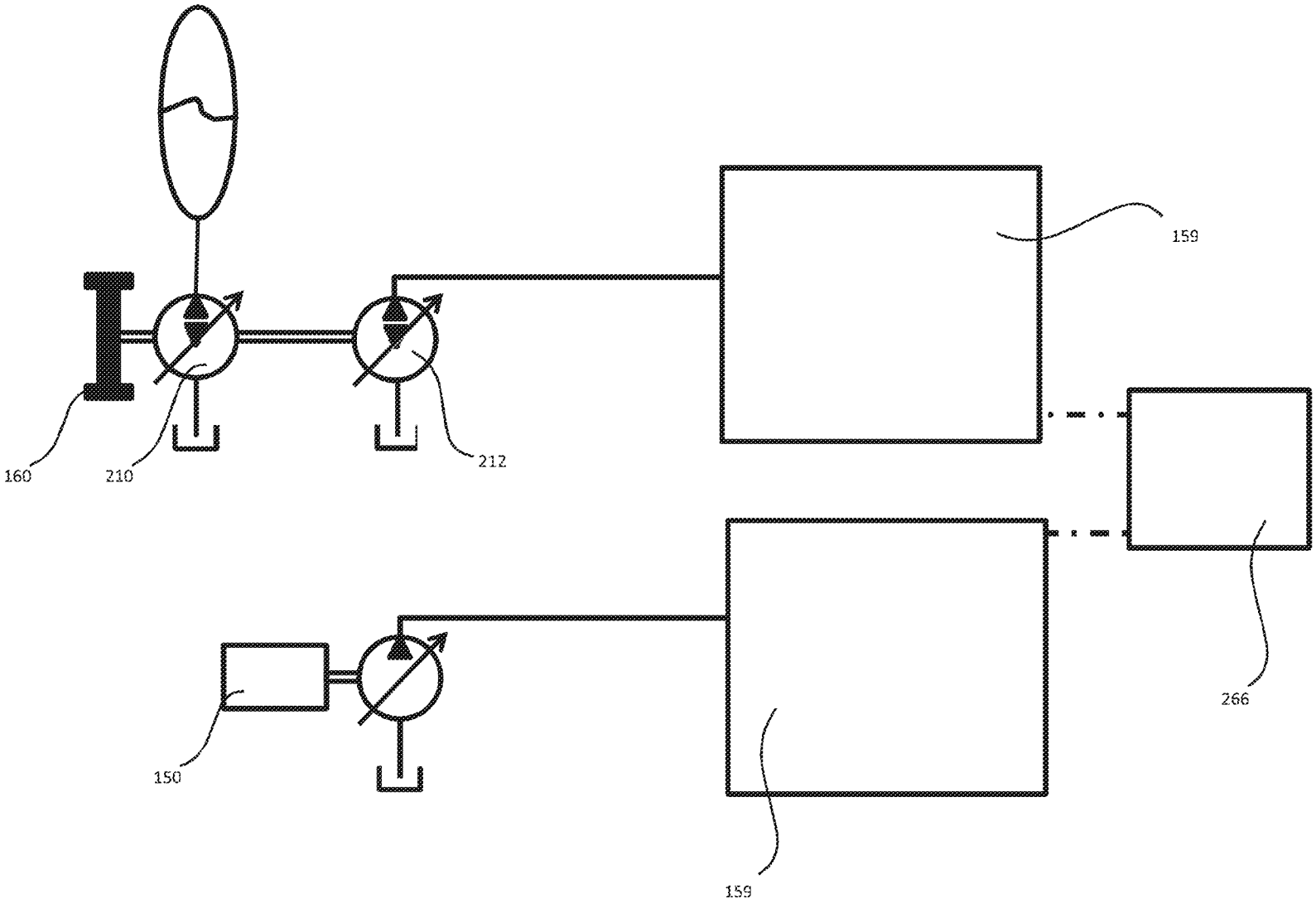
FIG. 6 provides a pair of hydraulic load circuits, connected via a common inertia.

The machine controller receives, as inputs, signals including the speed of rotation of the rotatable shafts of the pump and motor (E.g. FIG. 6), and a measurement of the pressure in the high pressure hydraulic fluid line. It may also receive a speed signal from a prime mover, and control signals (such as commands to start up or stop, or to increase or decrease high pressure hydraulic fluid line pressure in advance of), or other data as required.

The machine controller also takes into account resonances within the heavy construction equipment, such as resonances in the driveline, which can be measured using an accelerometer or strain gauge.

The machine controller comprises a single processor, in electronic communication with data storage, comprising a tangible computer readable medium, such as solid state memory, which stores the programme, and data required during operation. Machine controllers for the pump(s) and motor(s) and pump/motor(s), at least part of which functions as valve control modules, generate valve control signals responsive to requested displacement from another part of the machine controller and/or the system controller. Nevertheless, one skilled in the art will appreciate that the control of the transmission can be implemented as a plurality of distributed computing devices, each of which may implement parts of the overall control functionality, or as a single device.

Figure 25:
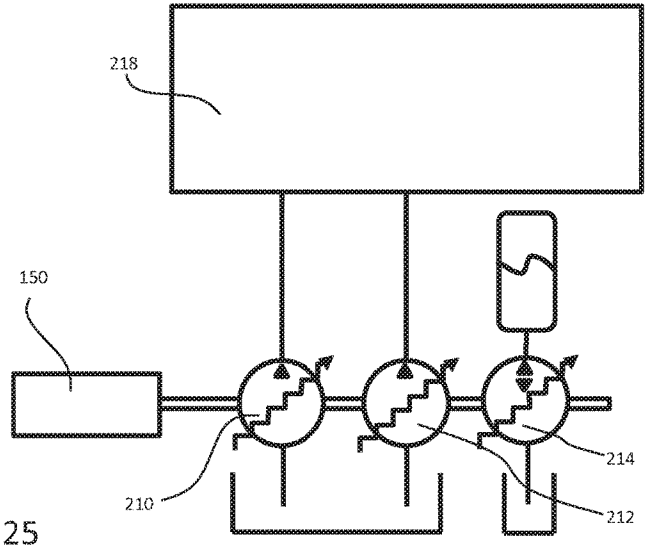

FIG. 25 illustrates the hydraulic pump in the form of an electronically commutated hydraulic pump comprising a plurality of cylinders which have working volumes defined by the interior surfaces of the cylinders and pistons which are driven from a rotatable shaft by an eccentric cam (or a ring cam) and which reciprocate within the cylinders to cyclically vary the working volume of the cylinders. The rotatable shaft is firmly connected to and rotates with the prime mover drive shaft. A shaft position and speed sensor determines the instantaneous angular position and speed of rotation of the shaft, and through signal line informs the machine controller of the pump speed, which enables the machine controller to determine the instantaneous phase of the cycles of each cylinder.

The cylinders are each associated with Low Pressure Valves (LPVs) in the form of electronically actuated face-sealing poppet valves, which face inwards toward their associated cylinder and are operable to selectively seal off a channel extending from the cylinder to a low pressure hydraulic fluid line, which may connect one or several cylinders, or indeed all as is shown here, to the low pressure hydraulic fluid line of the hydraulic circuit of the heavy construction equipment. The LPVs are normally open solenoid closed valves which open passively when the pressure within the cylinder is less than or equal to the pressure within the low pressure hydraulic fluid line, i.e. during an intake stroke, to bring the cylinder into fluid communication with the low pressure hydraulic fluid line, but are selectively closable under the active control of the controller via LPV control lines to bring the cylinder out of fluid communication with the low pressure hydraulic fluid line (so called 'synthetic commutation', hence 'synthetically commutated machine'). Alternative electronically controllable valves may be employed, such as normally closed solenoid opened valves.

The cylinders are each further associated with High Pressure Valves (HPVs) in the form of pressure actuated delivery valves. The HPVs open outwards from the cylinders and are operable to seal off a channel extending from the cylinder to a high pressure hydraulic fluid line, which may connect one or several cylinders, or indeed all as is shown here, to the transmission high pressure hydraulic fluid line. The HPVs function as normally-closed pressure-opening check valves which open passively when the pressure within the cylinder exceeds the pressure within the high pressure hydraulic fluid line. The HPVs also function as normally-closed solenoid opened check valves which the controller may selectively hold open via HPV control lines once that HPV is opened by pressure within the associated cylinder. Typically the HPV is not openable by the controller against pressure in the high pressure hydraulic fluid line. The HPV may additionally be openable under the control of the controller when there is pressure in the high pressure hydraulic fluid line but not in the cylinder, or may be partially openable, for example if the valve is of the type and is operated according to the method disclosed in WO 2008/029073 or WO 2010/029358.

In a normal mode of operation described in, for example, EP 0 361 927, EP 0 494 236, and EP 1 537 333, the contents of which are hereby incorporated herein by way of this reference, the machine controller selects the net rate of displacement of fluid from the high pressure hydraulic fluid line by the synthetically commutated machine by actively closing one or more of the LPVs shortly before the point of minimum volume in the associated cylinder's cycle, closing the path to the low pressure hydraulic fluid line which causes the fluid in the cylinder to be compressed by the remainder of the contraction stroke. The associated HPV opens when the pressure across it equalises and a small amount of fluid is directed out through the associated HPV. The motor controller then actively holds open the associated HPV, typically until near the maximum volume in the associated cylinder's cycle, admitting fluid from the high pressure hydraulic fluid line and applying a torque to the rotatable shaft. In an optional pumping mode the controller selects the net rate of displacement of fluid to the high pressure hydraulic fluid line by the hydraulic motor by actively closing one or more of the LPVs typically near the point of maximum volume in the associated cylinder's cycle, closing the path to the low pressure hydraulic fluid line and thereby directing fluid out through the associated HPV on the subsequent contraction stroke (but does not actively hold open the HPV). The controller selects the number and sequence of LPV closures and HPV openings to produce a flow or create a shaft torque or power to satisfy a selected net rate of displacement. As well as determining whether or not to close or hold open the LPVs on a cycle by cycle basis, the controller is operable to vary the precise phasing of the closure of the HPVs with respect to the varying cylinder volume and thereby to select the net rate of displacement of fluid from the high pressure to the low pressure hydraulic fluid line or vice versa.

The machine controller comprises a processor, such as a microprocessor or microcontroller, is in electronic communication through a bus with memory and an input-output port. The memory stores a program which implements execution of a displacement determination algorithm to determine the net volume of hydraulic fluid to be displaced by each cylinder on each cycle of cylinder working volume, as well as one or more variables which store an accumulated displacement error value and the memory also stores a database which stores data concerning each cylinder, such as the angular position of each cylinder and whether or not it is deactivated (for example, because it is broken). In some embodiments, the database stores the number of times each cylinder has undergone an active cycle. In some embodiments, the program comprises program code, functioning as the resonance determining module, which calculates one or more ranges of undesirable frequencies.

The controller receives a displacement demand signal, a shaft position (i.e. orientation) signal and typically a measurement of the pressure in the high pressure line, and a further input signal. The speed of rotation of the rotatable shaft is determined from the rate of change of shaft position and function as the speed of rotation of the rotatable shaft The outputs from the controller include high pressure valve control signals through high pressure valve control lines and low pressure valve control signals through low pressure valve control lines. The controller aims to match the total displacement from the cylinders to the displacement demand, over time. The shaft position is required to enable valve control signals to be generated in phased relationship with cycles of cylinder working volume. The measurement of pressure can be used to determine the exact amount of hydraulic fluid displaced or in other calculations. The controller might also receive signals indicating whether cylinders are broken, and should therefore be disabled, and to enable the database to be updated accordingly.

The hydraulic pump generally corresponds to the hydraulic motor except that it operates in the pumping mode described above and is typically on a larger scale. Instead of a single lobed eccentric there may be more, in the case of a multi-lobe ring cam. The high pressure valves need not be actively controlled by the controller and may comprise check valves.

During operation of the hydraulic transmission, the hydraulic machine controller receives input signals including the speed of rotation of the prime mover (which is the same as, or a geared ratio of the speed of rotation of the rotatable shaft of the hydraulic pump, as the two are coupled), and the pressure in the pressurised fluid hydraulic fluid line, as track speed or swing speed or ram speed. The machine controller next determines a target torque to be applied to the prime mover by the hydraulic pump, with reference to a look up table which summarises ideal target torque and shaft rotation speed at a plurality of different prime mover speeds. Once a target torque has been determined the machine controller then calculates the displacement of the hydraulic pump required to obtain the target torque. This is then transmitted to the hydraulic pump as the displacement demand signal received by the pump. Volumes of hydraulic fluid and rates of displacement may be calculated in any suitable units. This displacement demand can for example be expressed as a fraction of the maximum displacement of which the hydraulic pump is capable per revolution of the rotatable shaft. In this example, the displacement is expressed as an average percentage of the maximum output per revolution of the rotatable shaft. The actual rate of displacement which this represents, expressed as volume of fluid per second, will be the product of both the displacement demand, the maximum volume which can be displaced by a cylinder, the number of cylinders and the speed of rotation of the pump rotatable shaft. The resulting torque will be proportional to this displacement and to the pressure in high pressure hydraulic fluid line.

Once the pump displacement has been calculated, the hydraulic load displacement can also be calculated. Typically, the hydraulic load displacement is calculated to maintain a desired pressure in the pressurised fluid line. The calculated displacement is transmitted to the hydraulic load and received as the demand displacement signal of the motor. However, a number of other factors may be taken into account. For example, the hydraulic load displacement demand can be varied in order to vary the pressure in the high pressure hydraulic fluid line. There may be other factors. For example, it may be desirable for one or more hydraulic loads to be switched between being driven at a substantially constant torque, and being switched off, to minimise windage losses and maximise the efficiency of electricity generation.

There is a procedure carried out any synthetically commutated machine to determine the net displacement by each cylinder sequentially, in a default operating procedure (the first procedure), when it is not determined that unwanted frequencies will be generated. The procedure begins, whereupon a stored variable algorithmic accumulator is set to zero. The 'algorithmic accumulator', in more commonly known in computer science as an 'accumulator', however a different term is used here to differentiate from the entirely different concept of a hydraulic accumulator. The variable algorithmic accumulator stores the difference between the amount of hydraulic fluid displacement represented by the displacement demand and the amount which is actually displaced.

The rotatable shaft of the hydraulic motor then rotates until it reaches a decision point for an individual cylinder. For example there may be eight cylinders, and so each decision point will be separated by 45 degrees of rotation of the rotatable shaft. The actual period of time which arises between the decision points will therefore be the period of time required for the rotatable shaft to rotate by 45 degrees, which is inversely proportional to the speed of rotation of the rotatable shaft.

At each decision point, the motor controller reads the motor displacement demand received from the machine controller. The controller then calculates a variable algorithmic sum which equals algorithmic accumulator plus the demanded displacement. Next, the status of the cylinder which is being considered is checked. This is carried out with reference to the database of cylinder data. If it is found that the cylinder is deactivated (for example because it is broken), no further action is taken for that cylinder. The method then repeats from step once the decision point is reached for the next cylinder.

Alternatively, if it is found that the cylinder has not been disabled, then algorithmic sum is compared with a threshold. This value may simply be the maximum volume of hydraulic fluid displaceable by the cylinder, when the only options being considered are an inactive cycle with no net displacement or a full displacement active cycle in which the maximum displacement of hydraulic fluid by the cylinder is selected. However, the threshold may be higher or lower. For example, it may be less than the maximum displacement by an individual cylinder, for example, where it is desired to carry out a partial cycle, in which only part of the maximum displacement of the cylinder is displaced.

If algorithmic sum is greater than or equal to the threshold then it is determined that the cylinder will undergo an active cycle. Alternatively, if algorithmic sum is not greater than or equal to the threshold then it is determined that cylinder will be inactive on its next cycle of cylinder working volume, and will have a net displacement of zero.

Control signals are then sent to the low and high pressure valves for the cylinder under consideration to cause the cylinder to undergo an active or inactive cycle, as determined. (In the case of pumping, it may be that the high pressure valves are not electronically controlled and the control signals only concern the low pressure valves).

This step effectively takes into account the displacement demand represented by the displacement demand signal, and the difference between previous displacements represented by the displacement demand signal previous net displacements determined by the controller (in this case, in the form of the stored error), and then matches the time averaged net displacement of hydraulic fluid by the cylinders to the time averaged displacement represented by the displacement demand signal by causing a cylinder to undergo an active cycle in which it makes a net displacement of hydraulic fluid, if algorithmic sum equals or exceeds a threshold. In that case, the value of the error is set to SUM minus the displacement by the active cylinder. Alternatively, if algorithmic sum does not equal or exceed the threshold, then the cylinder is inactive and algorithmic sum is not modified.

It can therefore be seen that algorithmic accumulator maintains a record of the difference between the displacement which has been demanded, and the displacement which has actually occurred. On each cycle, the demanded displacement is added to the displacement error value, and the actual selected displacement is subtracted. Algorithmic accumulator effectively records the difference between demanded and provided displacement and an active cycle takes place whenever this accumulated difference exceeds a threshold.

One skilled in the art will appreciate that the effects of this displacement determination algorithm can be obtained in several ways. For example, rather than subtracting the selected displacement from the algorithmic accumulator variable, it would be possible to sum the displacement which has been demanded, and the displacement which has been delivered, over a period of time, and to select the displacement of individual cylinders to keep the two evenly matched.

In alternative embodiments, there may be sets of cylinders which are operated in phase throughout each cycle of cylinder working volume. For example, this may arise if the cam has multiple lobes or if there are multiple axially spaced banks of cylinders. In this case, at each decision point the selection of an active cycle or inactive cycle may be made for each cylinder in the set at once.

EXAMPLE APPLICATIONS OF THE INVENTION

The work functions previously referred to (e.g. boom ram, swing motor, track motors, jack hammer, pile driver etc.), may also be referred to as hydraulic loads, which are thus connected to services. For example in a first embodiment with two services the bucket and right hand track are connected to service 1, the boom is attached to service 1 (but during high flow demand will additionally connect service 2), the dipper (aka stick, or arm) may be connected to both services (or be attached to one service but during high flow demand will additionally connect the other service), the right hand track and the swing motor are connected to service 2. Additionally, if there is an auxiliary requirement like a breaker or jaw, this may be connected to service 2. Such an embodiment means that during high flow requirement of a swing operation, service 2 provides high flow, whilst service 1 may at the same time provide limited flow in order to meet the low flow demand of the boom.

In a second example embodiment with 3 services, the same connections between the services and loads may exist, other than the swing motor being connected to a service 3, thus allowing the service 3 to provide rates of flow and pressures which are independent to those loads connected to either of the other services.

In a third example embodiment with 3 services, the same connections between services and loads as the first example embodiment may exist, other than the boom being ordinarily solely connected to service 1, the dipper being ordinarily connected to service 2, but the two aforementioned loads, and any other loads requiring high flow may be connected to the roving service 3 as required.

In each case, the controller of the hydraulic machine receives a demand signal indicative of a pressure or flow rate required by a load and selects the net displacement of the cylinders connected to that load through the respective service to deliver the demand pressure or flow rate. Separate demand signals are received for different loads and the respective cylinders connected to the different loads are controlled accordingly. The demand signal(s) may be calculated by the controller, for example one program module may calculate the demand signal(s) and output that to a second program module which receives the demand signal (s) and uses that the control the displacement by individual cylinders.

FIG. 1 shows a flow impedance synthetically commutated pump circuit for hydraulic load sensing. FIG. 1 shows a synthetically commutated pump 100, a machine controller 128, a prime mover 150, a pump displacement demand 152, a pump output pressure 154, a load sense pressure 156, a pressure relief valve (PRV) 184, an orifice in the tank line 180, a two position solenoid valve "changeover valve" 182, and a load 158. The pump controller adjusts the synthetically commutated pump displacement based on $P_{LS}$ (hydraulic Load Sense Pressure), the pressure on the upstream side of a flow impedance. When the spool is moved to divert pump flow to the ram, the flow through the impedance reduces and so $P_{LS}$ reduces. The controller responds by increasing pump displacement. The controller limits $P_{out}$ (Output Pressure) to the maximum allowable circuit pressure. The controller also limits pump torque to avoid stalling the input shaft.

Figure 2:
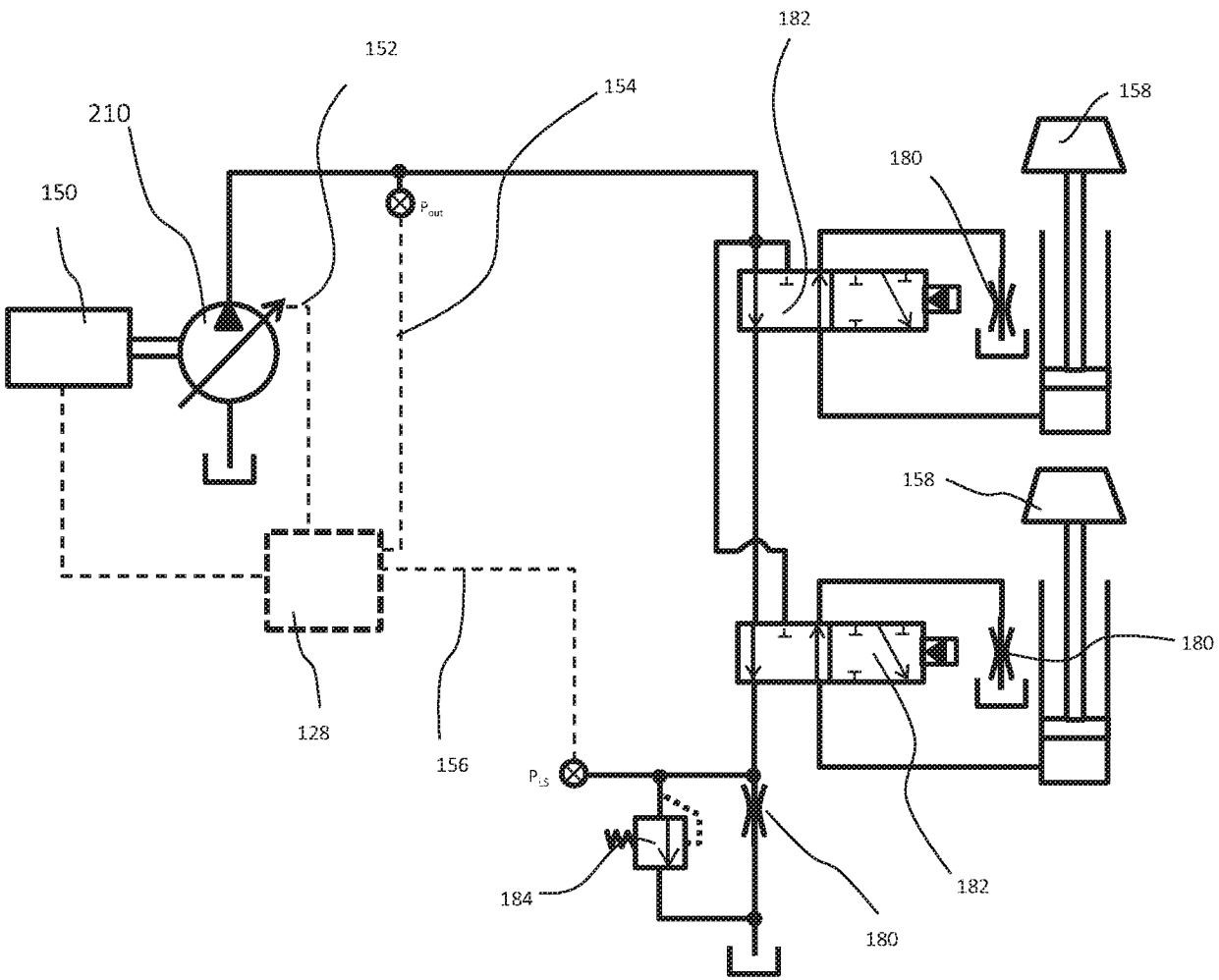

FIGS. 1 & 2 at least share in common that they embody a negative flow control concept, akin to negacon.

FIG. 2 shows a low impedance synthetically commutated pump hydraulic load sensing circuit, with multiple functions. FIG. 2 shows a machine controller 128, a prime mover 150, a pump displacement demand 152, a pump output pressure 154, a load sense pressure 156, a load 158, an orifice in the tank line 180, a two position solenoid valve "changeover valve" 182, a pressure relief valve (PRV) 184, and service 1 (210). In this example, the pump controller adjusts pump displacement based on $P_{LS}$, the pressure on the upstream side of a flow impedance. When a spool is moved by pilot pressure to divert pump flow to the ram, the flow through the impedance reduces and so $P_{LS}$ reduces. The controller responds by increasing pump displacement. The controller limits $P_{out}$ to maximum circuit pressure. The controller also limits pump torque to avoid stalling the input shaft.

Figure 3:
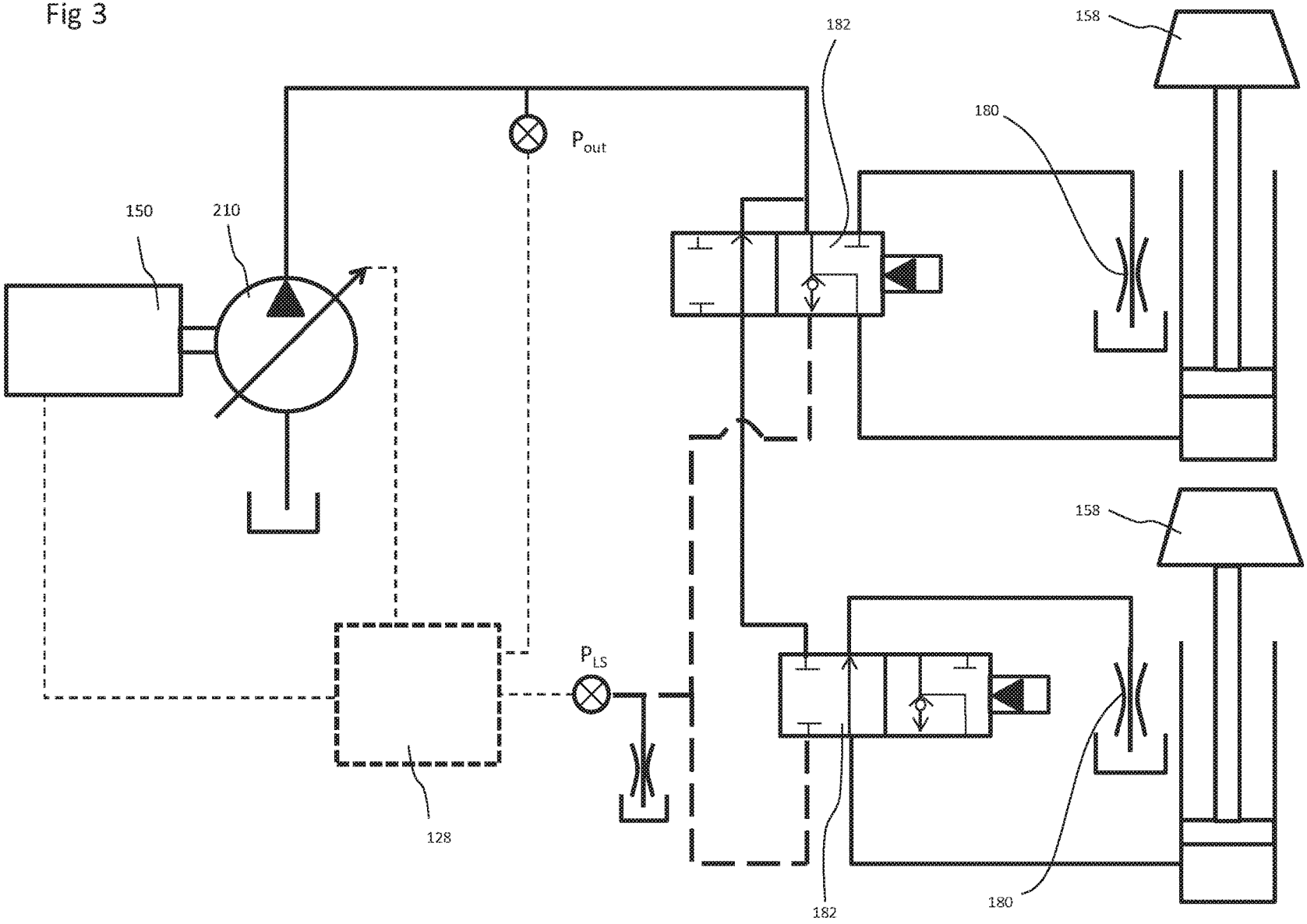

FIG. 3 shows a pressure offset pump hydraulic load sensing circuit, with multiple hydraulic loads attached. FIG. 3 includes a machine controller 128, a prime mover 150, a load 158, a two position solenoid valve "changeover valve" 182, and service 1 (210). The controller maintains $P_{out}$ above the $P_{LS}$ (highest hydraulic load pressure, as selected by the shuttle valve) by adjusting pump displacement. The controller limits $P_{out}$ to maximum circuit pressure. The controller also limits pump torque to avoid stalling the input shaft.

Figure 4:
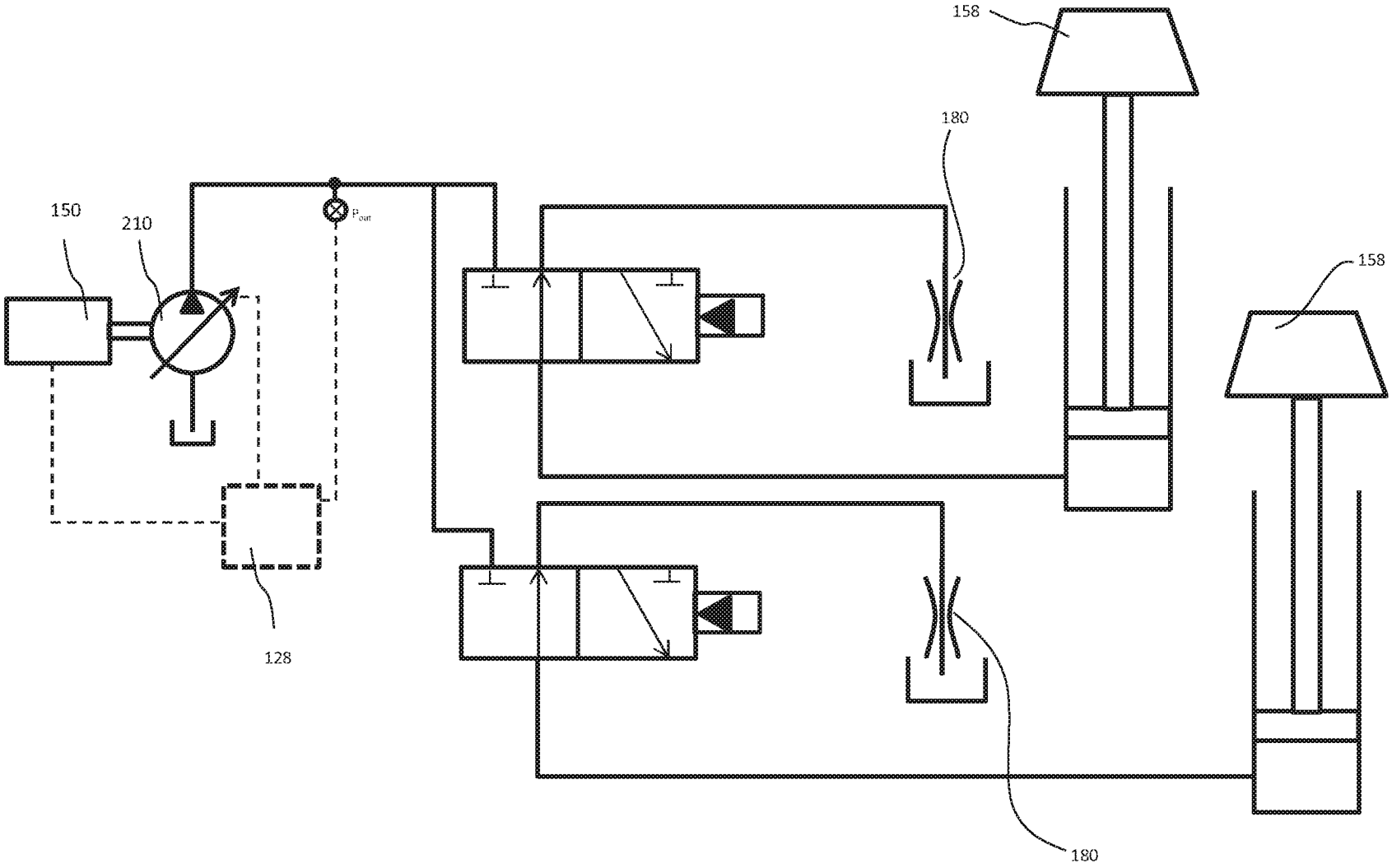

FIG. 4 shows a pressure control circuit. FIG. 4 includes a machine controller 128, a prime mover 150, a load 158, an orifice in the tank line 180, and service 1 (210). The controller adjusts pump displacement to maintain $P_{out}$, at some set pressure. Like a closed centre system, but as pump only makes up leakage flow at idle losses are much lower. The controller also limits pump torque to avoid stalling the input shaft.

Figure 5:
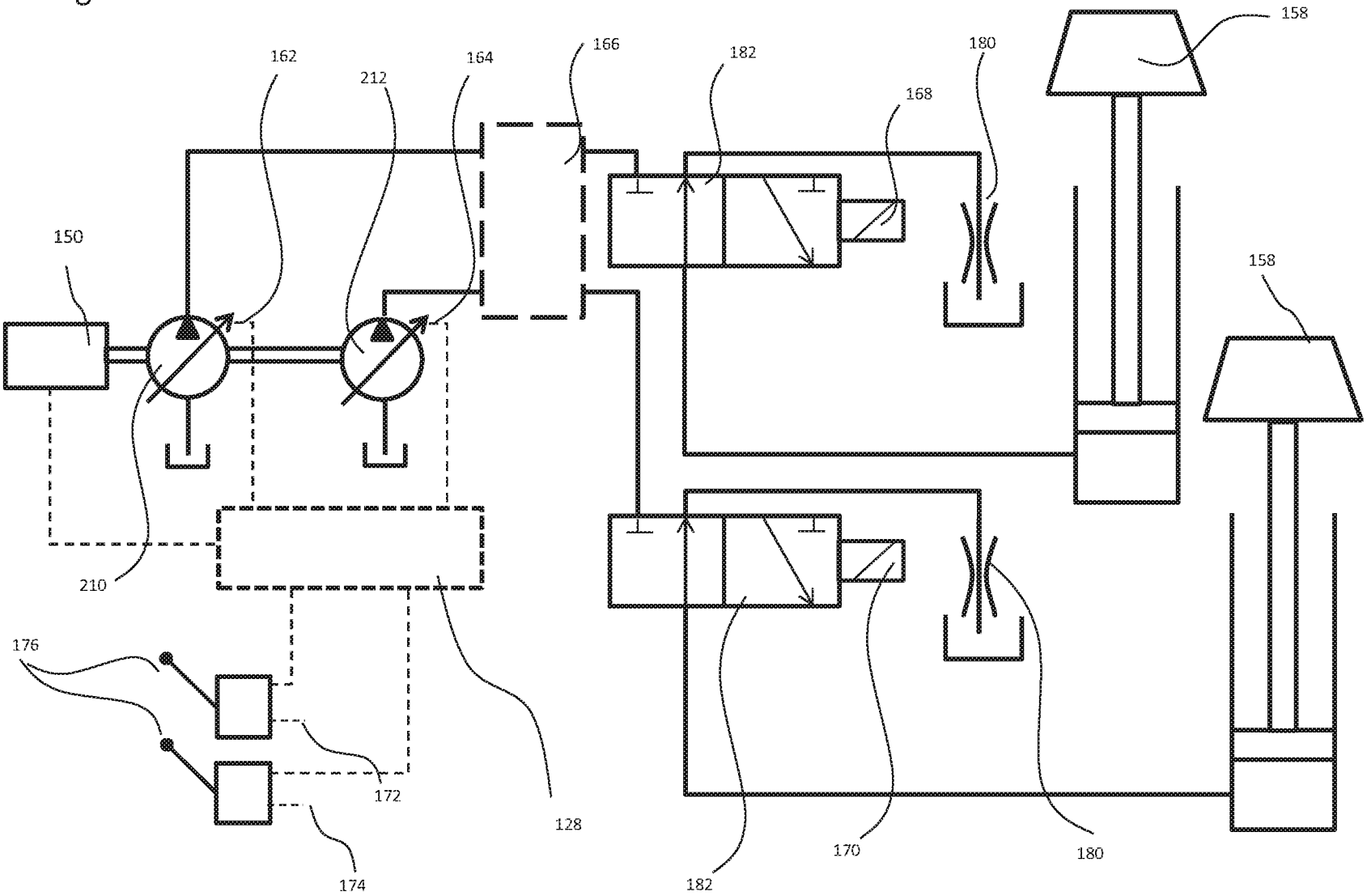

FIG. 5 shows a synthetically commutated pump direct ram control arrangement. FIG. 5 includes a machine controller 128, a prime mover 150, a load 158, a pump 1 displacement demand 162, and a pump 2 displacement demand 164, a ganging manifold 166, a valve solenoid 168, a valve solenoid 170, a To directional valve solenoid 1 (172), a To directional valve solenoid 2 (174), function control inputs 176, and an orifice in the tank line 180. The controller adjusts pump displacement according to control signal. The control signals also switch solenoid valves. Each function is connected to a separate service of the pump (service 1 (210), service 2 (212), . . . ). A ganging manifold 166 could be present to combine services. A valve matrix could be used with more functions. Valves can be controlled to switch which hydraulic load(s) are connected to which service(s) of the machine. Needs pressure feedback to allow pump torque limiting. Ram position feedback could be implemented.

FIG. 6 shows a pair of hydraulic load circuits 159, connected via a common inertia 266. A first hydraulic load circuit 159 is fluidly connected to a first synthetically commutated pump connected to a prime mover 150, and a second fluidly connected to a second synthetically commutated pump/motor 210. Thus the fluid circuits are distinct, and non-mixing. However energy may flow between the two as the hydraulic load circuits may share a common inertia. The two hydraulic load circuits may be connected purely by inertia. E.g. the first hydraulic load circuit is in the form of a wheel (or wheels) on the rear axle of a vehicle, and the second hydraulic load circuit is in the form of a wheel (or wheels) on the front axle, however clearly inertial generated for the first hydraulic load circuit, can simply energise the second circuit (for example during braking regeneration). A second synthetically commutated pump/motor can be used to transform accumulator pressure and/or store energy in flywheel 160. FIG. 6 further shows service 1 (210) and service 2 (212).

Figure 7:
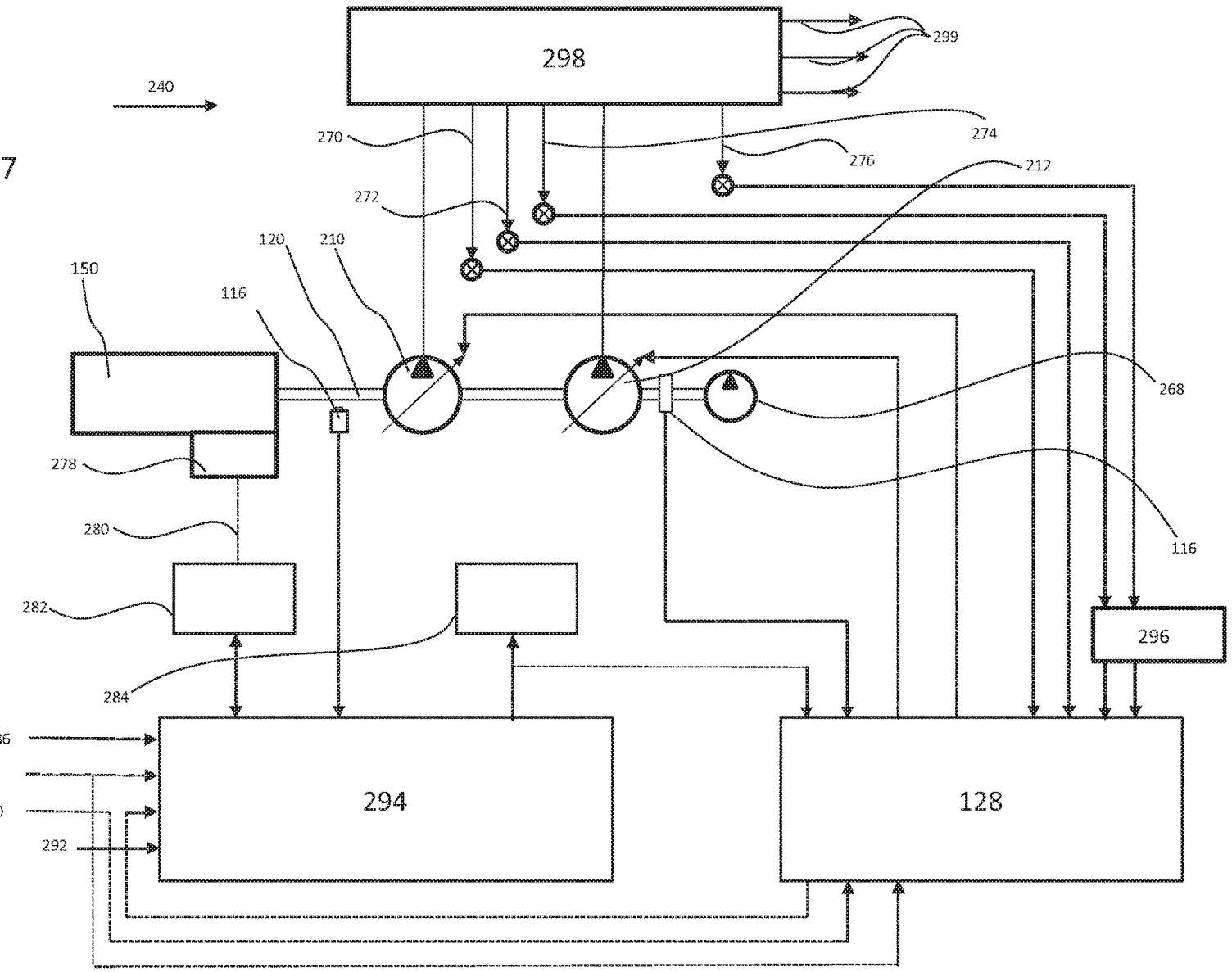
FIG. 7 is an individual image showing the hydraulic and electronic connections of a synthetically commutated machine controller within, and integrated with, an electro-hydraulic schematic incorporating both a synthetically commutated machine controller and an Engine Control Unit.

FIG. 7 shows a two service synthetically commutated pump, or a pair of synthetically commutated pumps. FIG. 7 shows a shaft position and speed sensor 116, a rotatable shaft 120, a machine controller 128, service 1 (210), service 2 (212), electrical signal (could be voltage, current, or CAN signal) 240, a servo pump 268, service 1 outlet pressure feed (hydraulic control signal) 270, service 2 outlet pressure feed (hydraulic control signal) 272, LS1 pressure feed (hydraulic control signal) 274, LS2 pressure feed (hydraulic control signal) 276, a fuel pump 278, a hydraulic control signal 280, a Throttle electro proportional valve 282, a pump torque electro proportional valve 284, an auto idle mode 286, an operation mode 288, a throttle dial 290, function pressure switches 292, an existing Engine Control Unit 294, a system controller 296, and a synthetically commutated machine body/valve block 298, and hydraulic connections to functions 299. In the Figure as shown, the Hydraulic load Sense embodiment demonstrates that LS1 signal always tries to maintain a (for example 20 bar) pressure difference above LS2 signal. Alternatively, the demand simply follows the LS2 signal. It can be seen that the system controller (296) receives LS1 & LS2 pressure feeds 274, 276, and may additionally send a corresponding signal to the machine controller (128).

Other options would be for the pump controller to control pump torque limit directly (would need engine torque/speed lookup) and/or for the pump controller to adjust engine speed by diverting throttle control via pump controller. The system controller, in FIG. 7 is optional (hence dashed lines).

Figure 8:
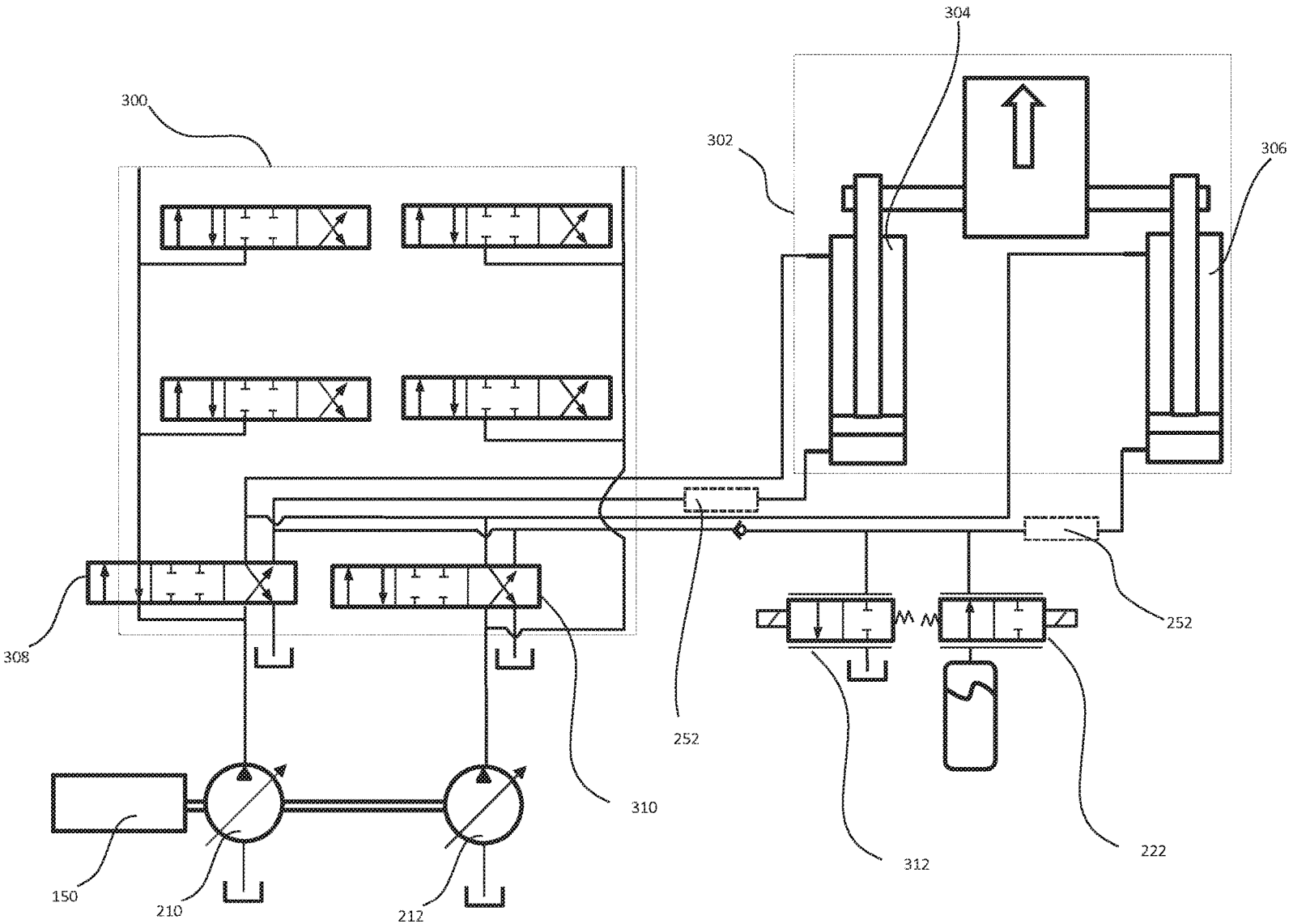
FIGS. 8 to 12 show the integration of a synthetically commutated machine (pump, motor, or pump-motor) into an excavator hydraulic circuit comprising a pair of rams acting in parallel to raise and lower a boom.

FIG. 8 shows a two service synthetically commutated pump, or a pair of synthetically commutated pumps. FIG. 8 includes a prime mover 150, service 1 (210), service 2 (212), an accumulator valve (switch 4') (222), a load holding valve 252, a valve block 300, a boom (parallel rams) 302, ram 1 (304), ram 2 (306), switch 1 (308), and switch 2 (310). The switch valves are in an arrangement where the boom is being lifted. In particular, pressure in the accumulator serves to provide pressure to ram 2 (306). When the boom 302 is lowered, energy can be recovered by storing pressurised fluid in the accumulator via switch 4 (222).

Figure 9:
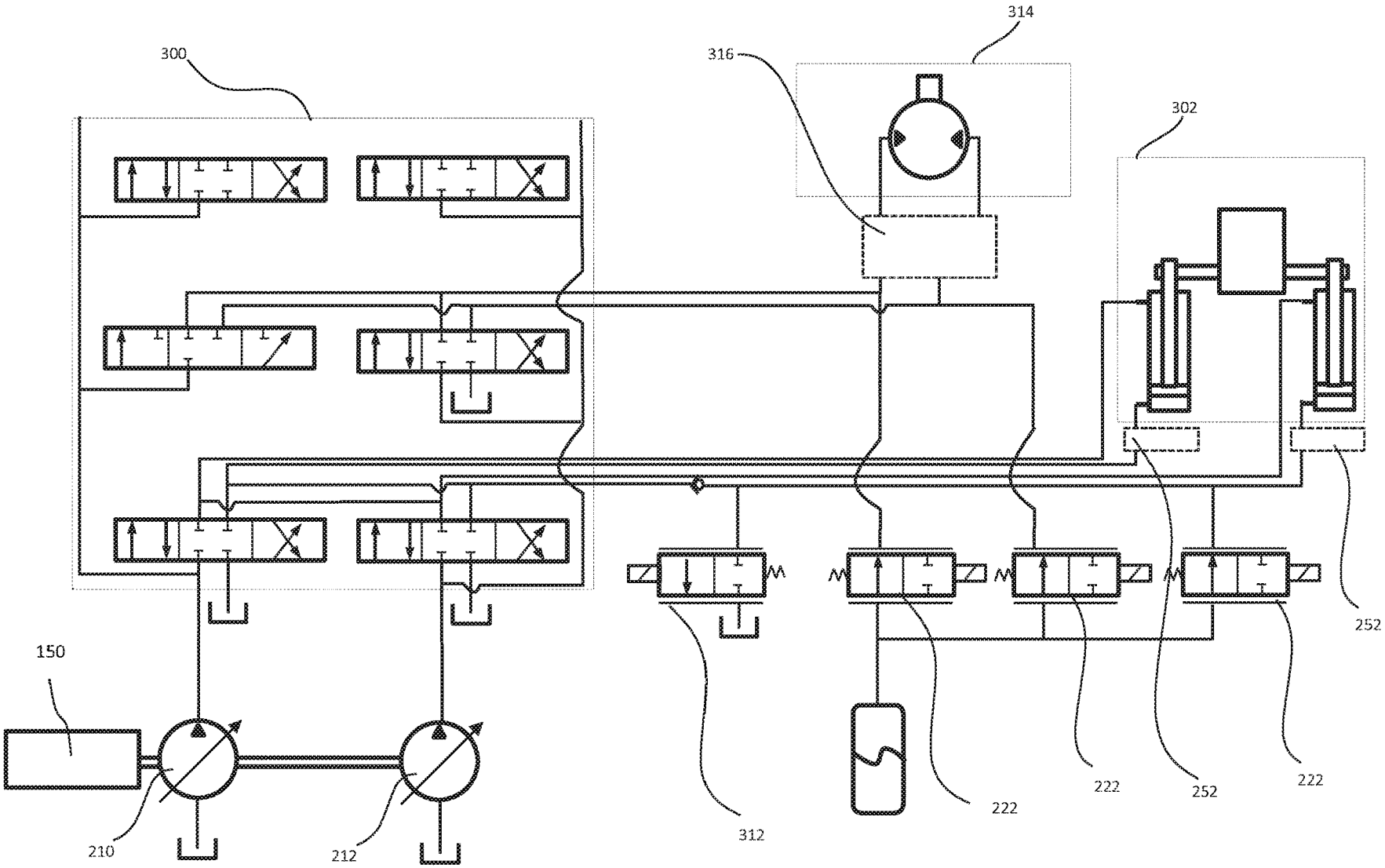

FIG. 9 shows a two service synthetically commutated pump, or a pair of synthetically commutated pumps, and additionally a swing function 314 coupled to a pair of connections in the valve bock 300. The swing function connection means that swing energy recovery is possible, by directing pressure arising from swing to charge an accumulator. FIG. 9 further shows a prime mover a prime mover 150, an accumulator valve (switch 4') 222, a load holding valve 252, a boom 302, and valves arrangement 316 to stop the swing arm from simply under gravity falling to one side.

Figure 10:
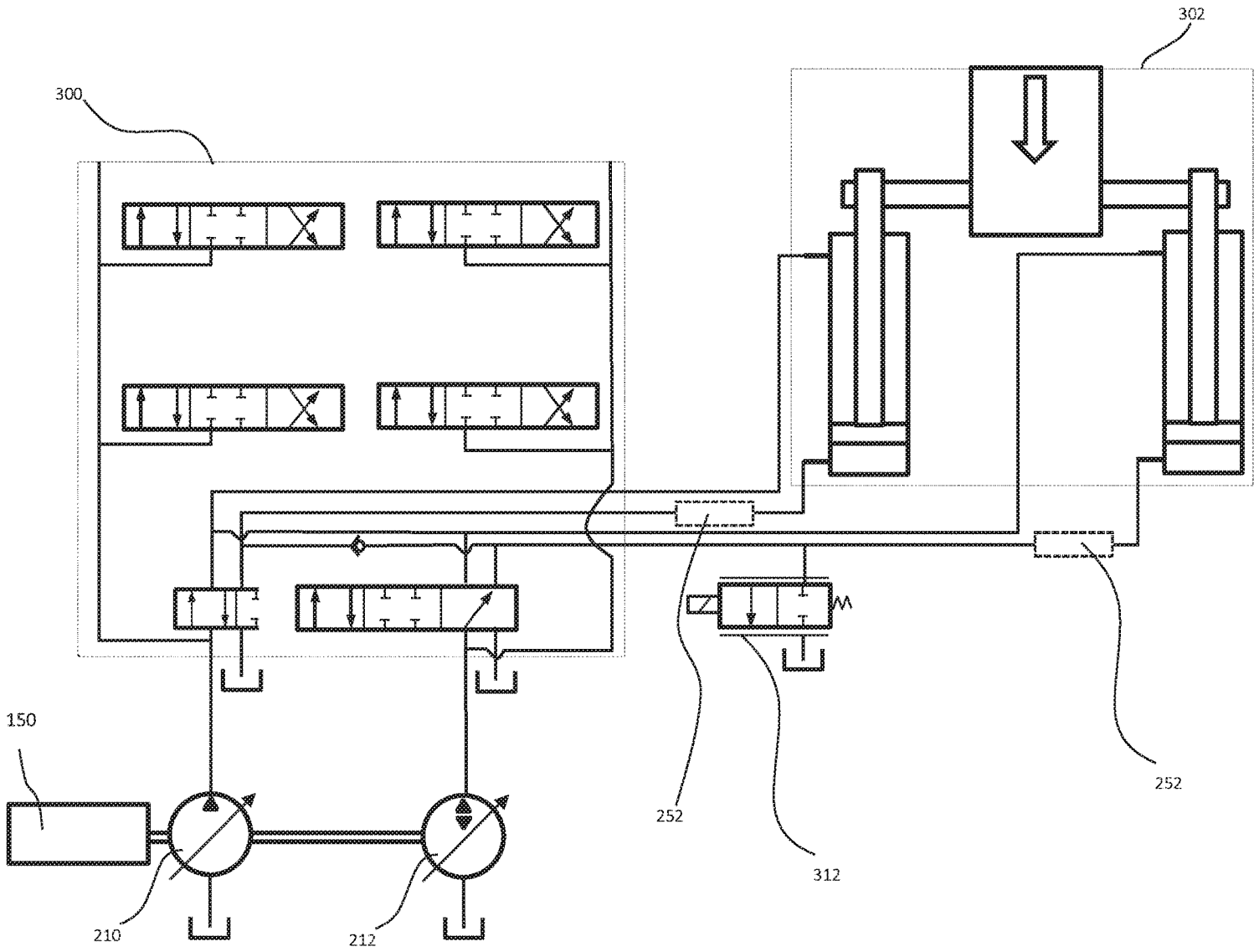

FIG. 10 shows a synthetically commutated machine or machines, comprising a first service as a supply, and a second service as a sink/supply, depending on pumping/motoring configuration selected. FIG. 10 shows a prime mover 150, service 1 (210), service 2 (212), a load holding valve 252, a valve block 300, a boom 302, and switch 3 (dump valve) 312. In this example, there is no accumulator. Lowering of the boom requires supply to sink/service 2 (212) is motoring, and service 1 (210) is pumping. Flow from supply 1 available to other functions. Switch 1 (308) provides spool metering flow to ram 1 (304). When service 3 has reached maximum flow, this dump valve 312 can improve lowering speed. The image only partially illustrates the left hand control element in primary feed valve in valve block 300, and it will be understood by one skilled in the art that the missing elements are simply obscured from view due to space limitations, and that the options that may be embodied are simply the same options as those illustrated in previous FIGS. 8 & 9.

Figure 11:
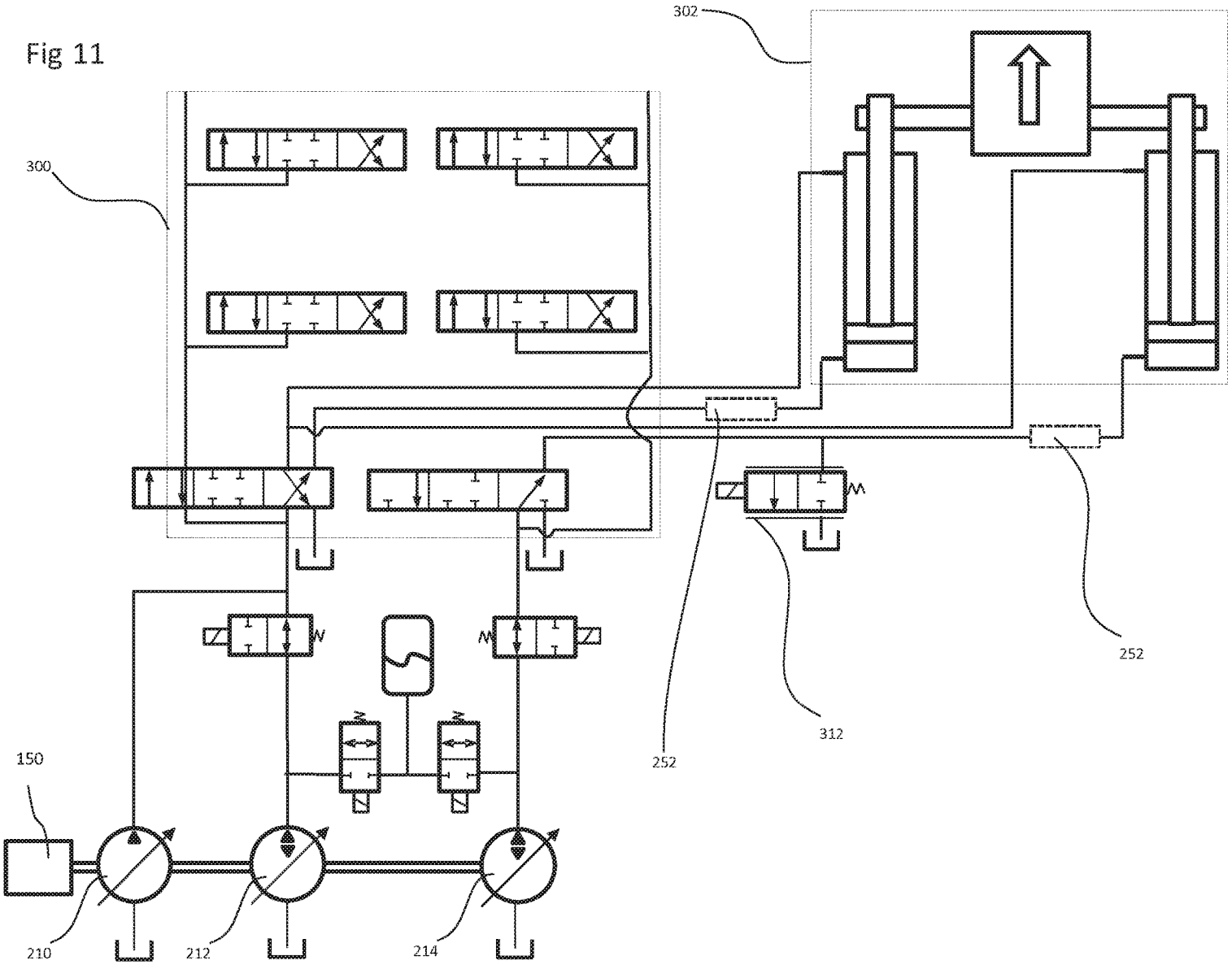

FIG. 11 shows a synthetically commutated machine or machines, comprising a first service as a supply, and a second service as a sink/supply, and a third service as a sink/supply. The second and third connections can be used together to function as a transformer. In order to perform lifting, the accumulator can be charged or discharged directly (no pulsation issues, or charged or discharged via the transformer made up of fluid supplies 2 and 3. FIG. 11 shows a prime mover 150, service 1 (210), service 2 (212), service 3 (214), a load holding valve 252, a valve block 300, a boom 302, switch 3 (dump valve) 312.

Figure 12:
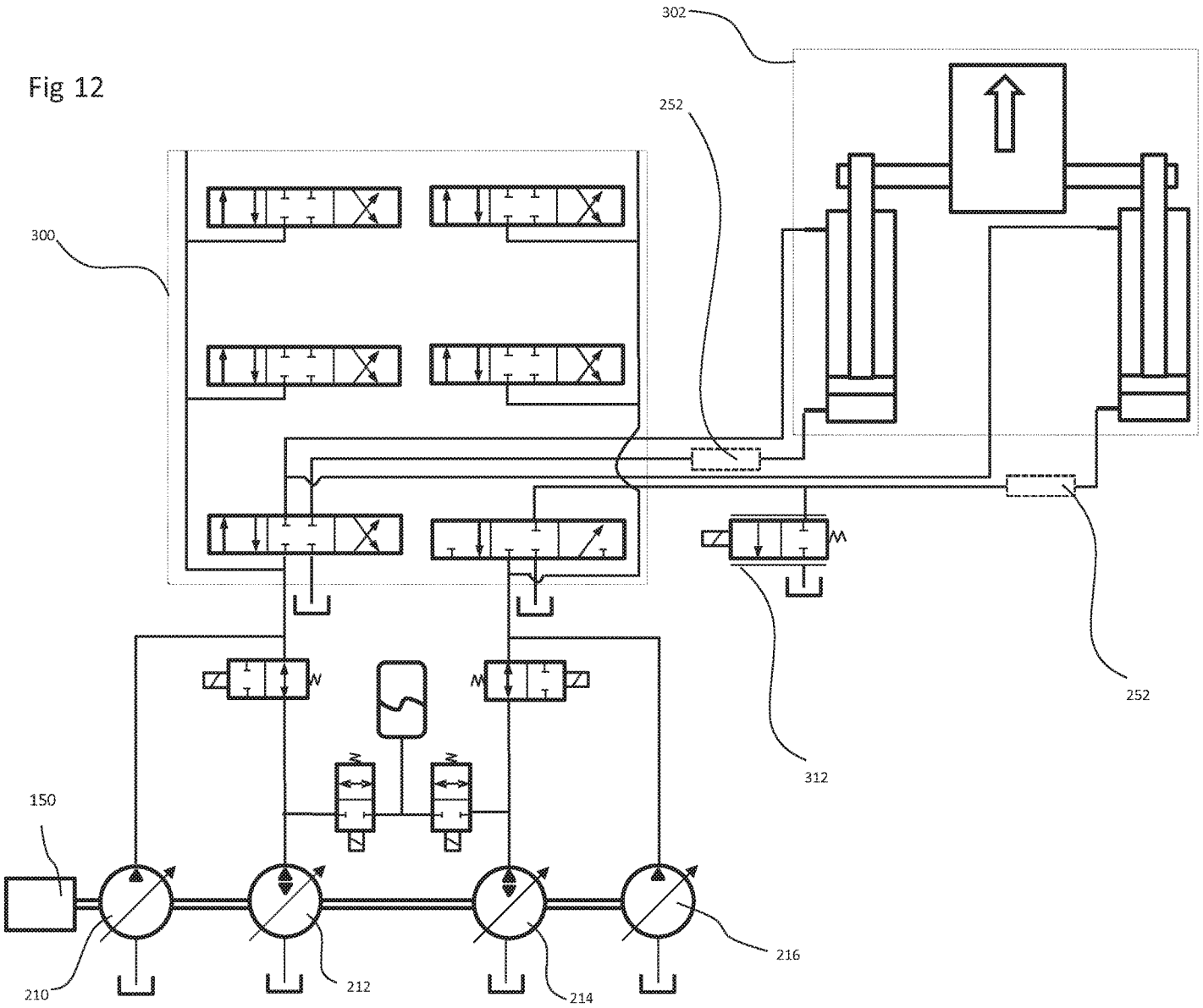

FIG. 12 is an example of a synthetically commutated machine or machines, comprising a first service as a supply, and a second service as a sink/supply, and a third service as a sink/supply, and a fourth service as a supply. The accumulator can be charged or discharged directly without connection to a synthetically commutated machine. The accumulator can be charged or discharged via the transformer comprising service 2 (212) and service 3 (214). FIG. 12 further shows a prime mover 150, service 1 (210), service 4 (216), a load holding valve 252, a valve block 300, a boom 302, and switch 3 (dump valve) 312.

Figure 13:
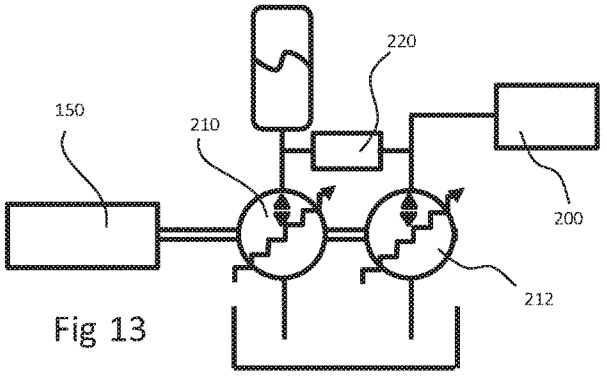
FIGS. 13 to 25 outline a variety of hydraulic circuits, which could be applied within an excavator, or other heavy construction equipment. Nb. All figures in the specification feature synthetically commutated machines, however the variable pump/motor symbol shown differs between FIGS. 1-12 and 13-24. Although the second group of figures feature a diagonal line having a discrete number of steps, the steps shown are purely pictorial. Synthetically commutated machines may be operated in a virtually infinitely variable mode, and hence the number of steps shown in the diagonal line is not significant due to its symbolic meaning. Also, although each circle may be understood to be a single machine, each may also represent an individual service. Thus two pump services may be from two machines, or from a single machine.

FIG. 13 is an example of a circuit with a synthetically commutated machine or machines, capable of a hydraulic transforming function. FIG. 13 shows a prime mover 150, a load 200, service 1 (210), service 2 (212), and a ganging valve 220.

Figure 14:
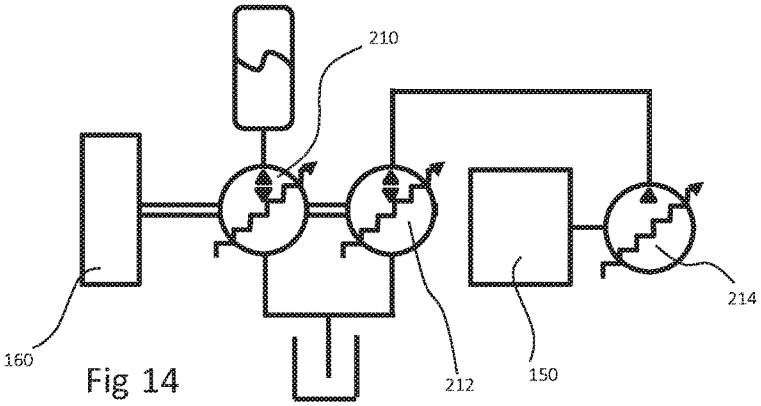

FIG. 14 is an example of a circuit with a synthetically commutated machine or machines, capable of a hydraulic transforming function. FIG. 14 shows a prime mover 150, a flywheel 160, service 1 (210), service 2 (212), and service 3 (214).

Figure 15:
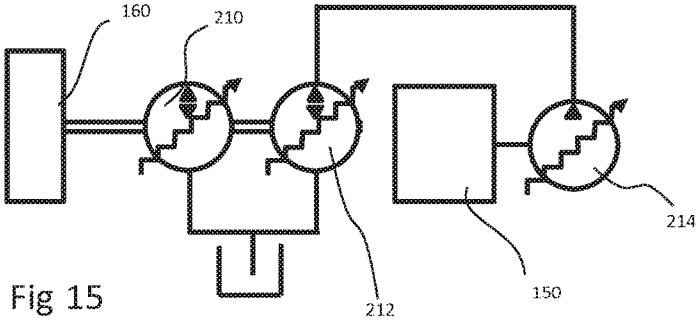

FIG. 15 is an example of a circuit with a synthetically commutated machine or machines, capable of a hydraulic transforming function. FIG. 15 shows a prime mover 150, a flywheel 160, service 1 (210), service 2 (212), and service 3 (214).

Figure 16:
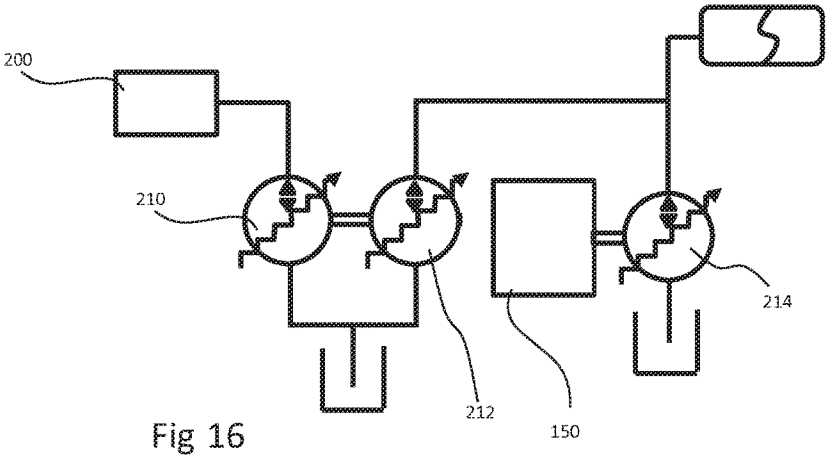

FIG. 16 is an example of a circuit with a synthetically commutated machine or machines, capable of a hydraulic transforming function. FIG. 16 shows a prime mover 150, a load 200, service 1 (210), service 2 (212), and service 3 (214).

Figure 17:
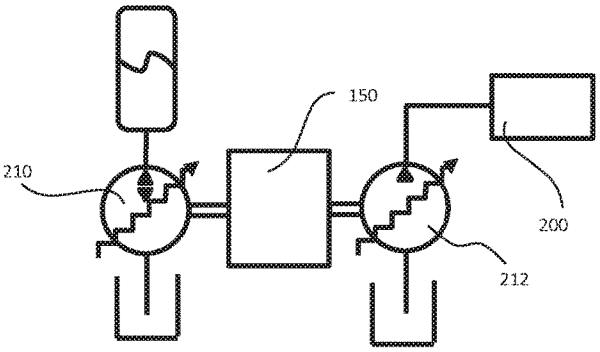

FIG. 17 is an example of a circuit with a synthetically commutated machine or machines, capable of a hydraulic transforming function. FIG. 17 shows a prime mover 150, a load 200, service 1 (210), and service 2 (212).

Figure 18:
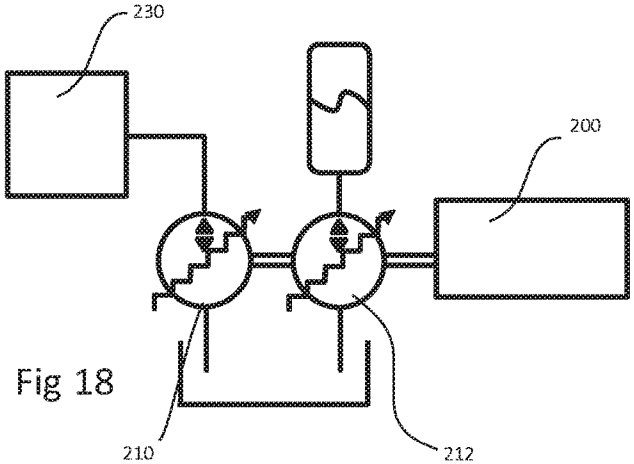

FIG. 18 is an example of a circuit with a synthetically commutated machine or machines, capable of a hydraulic transforming function, where the load 200 is typically an electrical generator. FIG. 18 further shows service 1 (210), and service 2 (212), and a fluid supply or sink 230.

Figure 19:
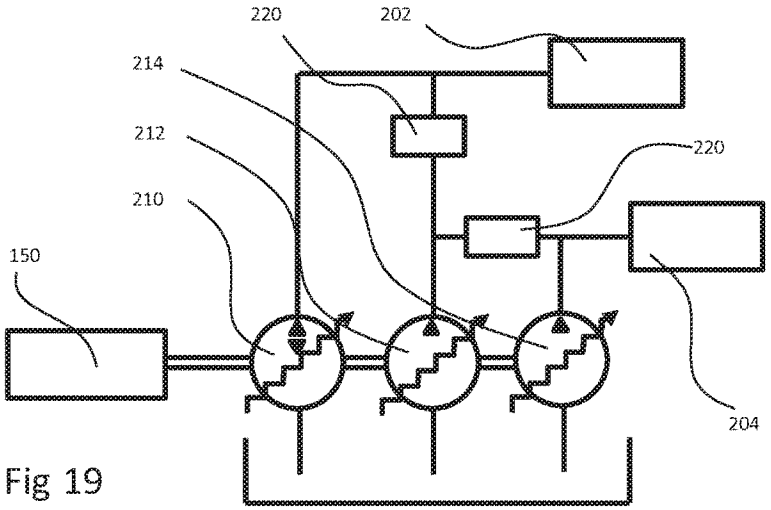

FIG. 19 is an example of a circuit with a synthetically commutated machine or machines, capable of a hydraulic transforming function. This circuit includes the possibility of one of the services, being a directable, controllable independent service. In the Figure, as shown, this directable service would be 'pump/service 2' as labelled. FIG. 19 further shows a prime mover 150, load 1 (202), load 2 (204), service 1 (210), service 2 (212), service 3 (214), and a ganging valve (220).

Figure 20:
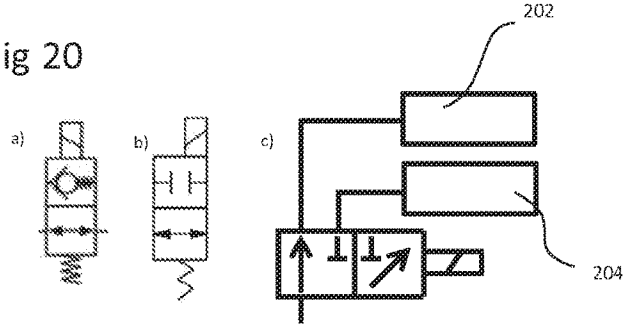

FIG. 20 provides three example valve options for the changeover valves (182, 183), various ganging valves (220), accumulator valves (222), final ganging valves (224), load holding valve (252), and shuttle valve (254) disclosed explicitly or implicitly as understood by one skilled in the art, in FIGS. 8 to 26). The options illustrated are a) energise for 1-way check, b) energise to block flow, c) L1/L2 switching valve (directional valve). Although not illustrated, and understood by one skilled in the art, d) other type of valve is possible.

Figure 21:
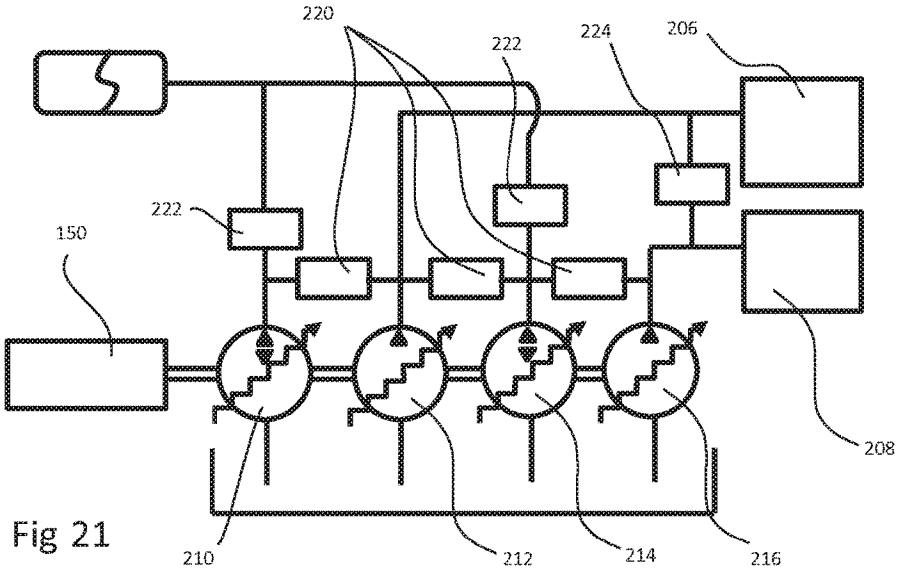

FIG. 21 is an example of a circuit with a synthetically commutated machine or machines, capable of a hydraulic transforming function. FIG. 21 shows a prime mover 150, service 1 (210), service 2 (212), service 3 (214), service 4 (216), load sense 1 (206), load sense 2 (208), a ganging valve 220, an accumulator valve (switch 4') 222, and a final ganging valve 224. Services 1&2 may be a single machine (single body/case/casting), and services 3&4 likewise. It may be that services 1&3 are each 3 cylinders connectable, and services 2&4 are each 9 cylinders connectable. This circuit includes the possibility of one of the services, being a directable, controllable independent service. As can be understood by one skilled in the art, each service shown has a drain and a hydraulic line. Also understood, as shown, is that the valves between the services (the ganging valve (220) between hydraulic line of service 1 (210) and hydraulic line of service 2 (212), the ganging valve (220) between hydraulic line of service 2 and hydraulic line of service 3, and the ganging valve (220) between the hydraulic line of service 3 (214) and hydraulic line of service 4 (216), are used to connect or gang respective services. Service flow to or from the load sense 1 (206) and the load sense 2 (208) may be ganged using the final ganging valve (224) located between the fluid connection of the two load sense components.

The accumulator is optional, and if present could be used for energy storage. In embodiments which exclude the accumulator, the corresponding valves can also be omitted (i.e. the accumulator valve (222) between hydraulic line of service 1 (210) and accumulator, and the valve between the hydraulic line of service 2 (212) and accumulator.

There may be more than two load sensing loads. The ganging valves (220) can be used to combine services. The division of functions (e.g. boom ram, rotary actuator, tracks) between the load sensing loads may be chosen to reflect the operational requirements of the machine. A roving service (i.e. an additional controllable independent service) can be included to provide additional flow to a load when required. In an example where the roving service could be a pump-motor, this allows energy recovery by engine offloading (i.e.

by applying torque to support and add to the engine torque) and also allows charging of the accumulator. More specifically, the roving service may be connected to one or more of the following functions i) rotary actuator for rotating the cab and thus capable of slew regeneration, ii) boom ram thus capable of boom regeneration, iii) one or more other service, thus capable of boosting the respective function, iv) stick ram thus capable of ram regeneration. Boosting is simply the addition of one service with that of another to increase the flow and/or pressure that the boosted service may provide (e.g. as a pump) or may accept (e.g. as a motor). In one embodiment, the roving service may be connected only to ii) and/or iv) above.

Each load sense load (two are illustrated, however there might be more), could be a number of functions, or a single function.

Figure 22:
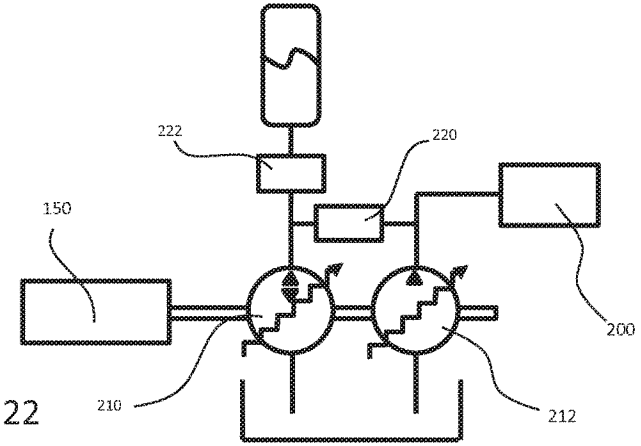

FIG. 22 is an example of a circuit with a synthetically commutated machine or machines, capable of a hydraulic transforming function. One of the synthetically commutated machines shown, is shown as a pump-motor, and one skilled in the art can quickly appreciate that motoring of this machine may occur due to pressurised fluid from the accumulator (the connection is controlled by the intermediate accumulator valve) and/or pressurised fluid from the other branch connected to the other synthetically commutated machine (the connection is controlled by the intermediate ganging valve). FIG. 22 shows a prime mover 150, a load 200, service 1 (210), service 2 (212), ganging valve 220, and an accumulator valve (switch 4') 222.

Figure 23:
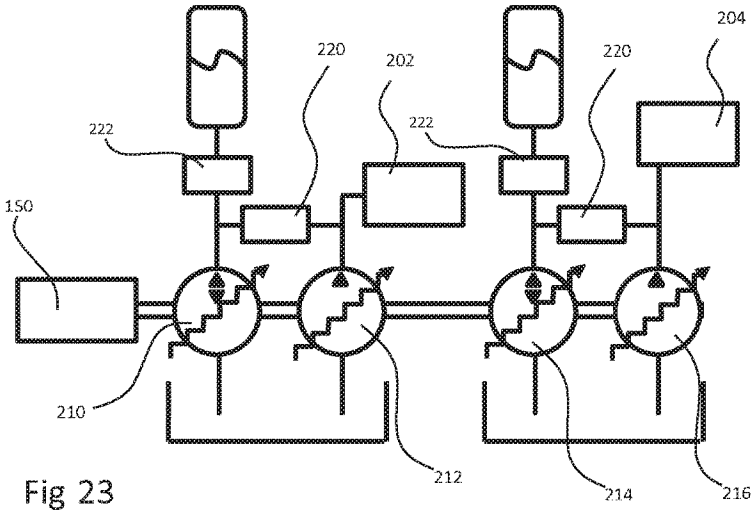

FIG. 23 is an example of a circuit with hydraulic transforming function. FIG. 23 shows a prime mover 150, load 1 (202), load 2 (204), service 1 (210), service 2 (212), service 3 (214), service 4 (216), ganging valves 220, and an accumulator valve (switch 4') 222. This hydraulic arrangement is equivalent to doubling the elements of FIG. 22 connected to the prime mover (a two pair arrangement), and having a common shaft between the four machines. As can be seen by one skilled in the art, any time the pump-motor of one 'pair' is driven by pressurised fluid (either from the accumulator, or from the other branch), then the common shaft is also driven, meaning that the other pair of machines at the other end of the shaft (as shown) are also driven. Thus each pair of synthetically commutated machines is torque connected to the other pair (relevant to pumping and motoring operations), but they are hydraulically separate, especially in terms of being subject to disparate pressures/flows.

Figure 24:
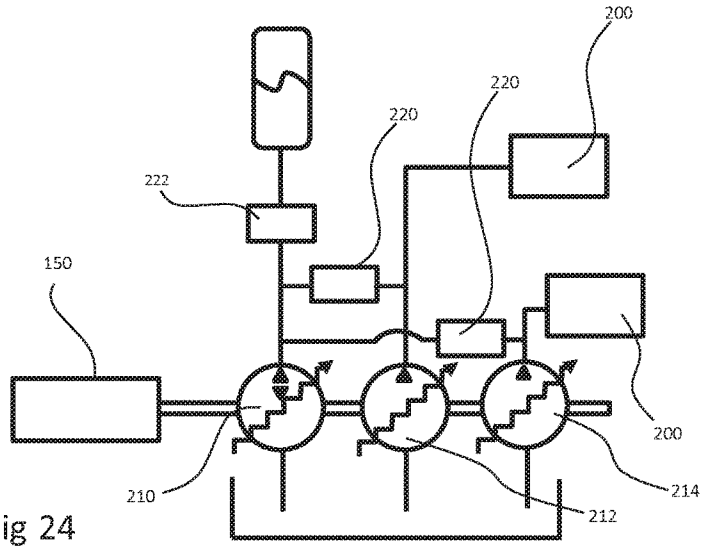

FIG. 24 is an example of a circuit with a synthetically commutated machine or machines, capable of a hydraulic transforming function. FIG. 24 shows a prime mover 150, a load 200, service 1 (210), service 2 (212), service 3 (214), ganging valves 220, and an accumulator valve (switch 4') 222. This hydraulic arrangement is similar to FIG. 22, but comprises an additional synthetically commutated machine in the form of a pump, with its own corresponding load. Associated with it is a further intermediate ganging valve which may be used to connect that pump to the fluid connection of the pump-motor machine.

FIG. 25 is an example of a circuit with a synthetically commutated machine or machines, capable of a hydraulic transforming function. FIG. 25 shows a prime mover 150, service 1 (210), service 2 (212), service 3 (214), and an excavator hydraulic circuit 218 with connections to rams, hydraulic motors etc. This hydraulic arrangement features a pump-motor which is dedicated to an accumulator, and is not hydraulically connected or connectable to an additional hydraulic machine. As per previous image, it is conceivable there is a valve between the pump-motor and the accumulator. The load as shown, is common between the two pumps, however as per previous images, it may be that the pumps are dedicate to particular loads, possibly having ganging valves between the pumps (as per previous images) for the purpose of sharing the load between pumps.

Figure 26:
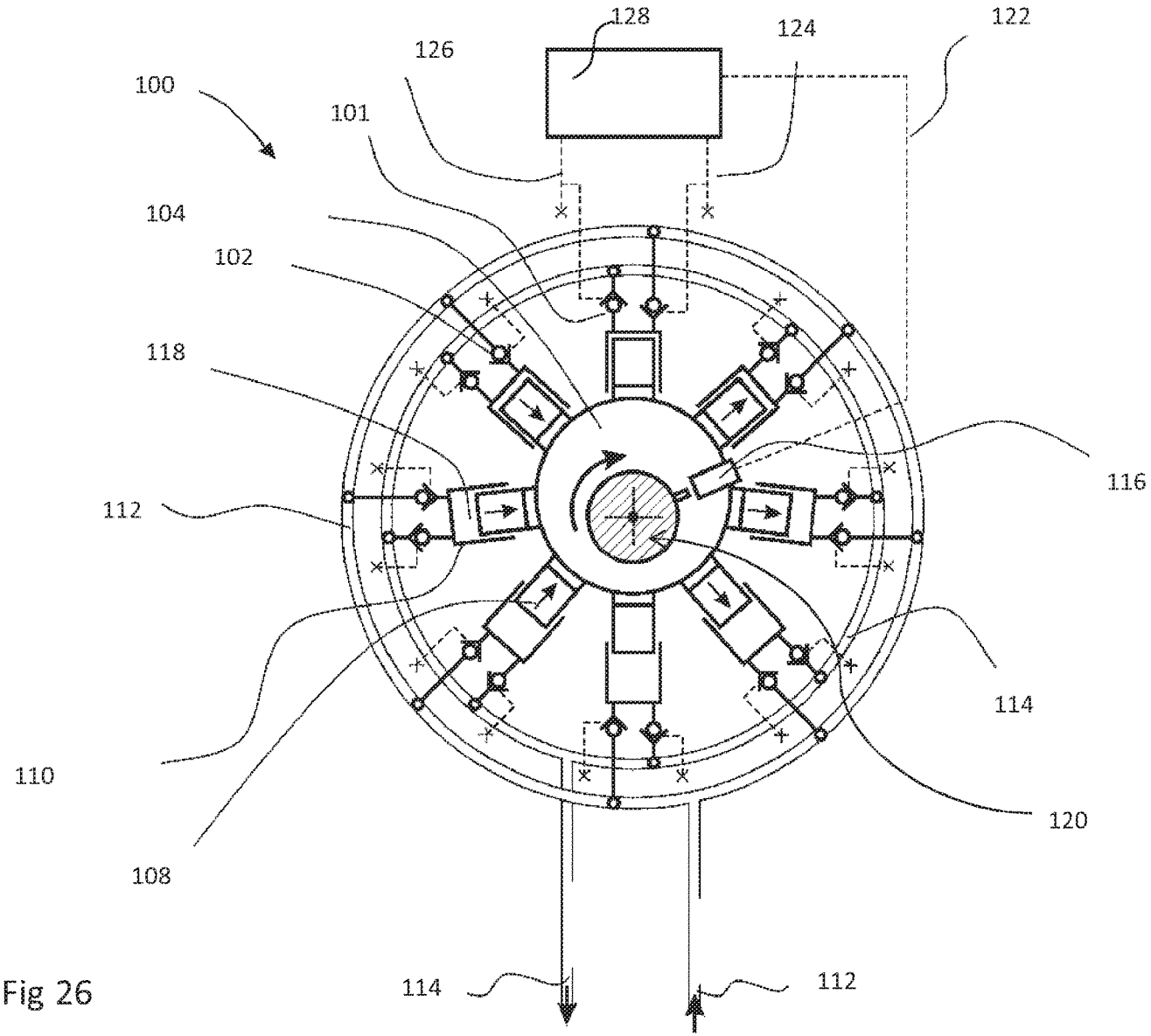
FIG. 26 is a schematic diagram of a synthetically commutated machine comprising a number of working chambers.

FIG. 26 is a composite image a synthetically commutated machine. FIG. 26 shows a synthetically commutated machine 100 including a low pressure valve 101, a high pressure valve 102, an eccentric cam 104, pistons 108, cylinders 110, a high pressure fluid line 112, a low pressure fluid line 114, a shaft position and speed sensor 116, a working volume/working chamber 118, a signal line 122, a high pressure valve control line 124, a low pressure valve control line 126, and a machine controller 128.

Figure 27:
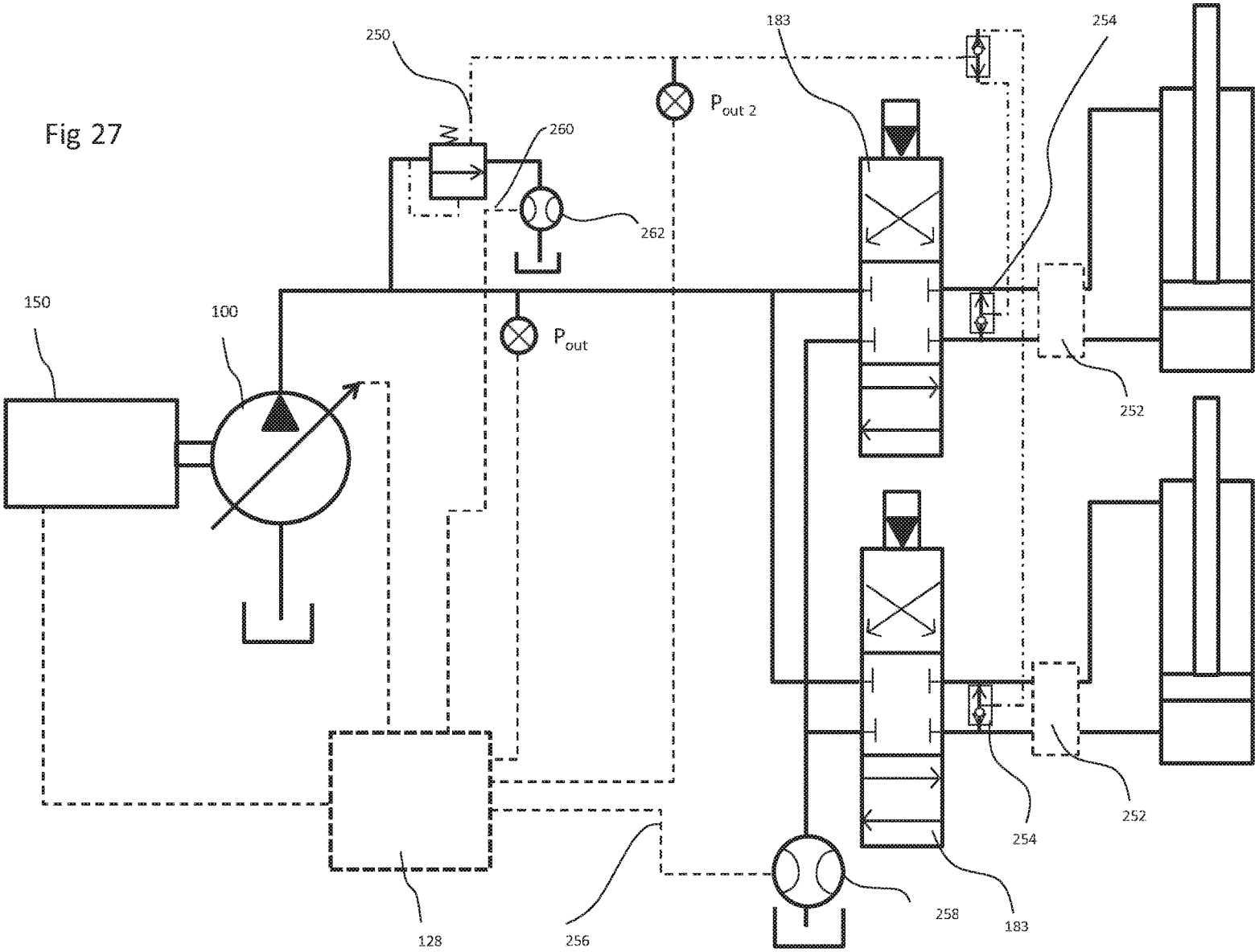
FIG. 27 is a schematic diagram of a hydraulic circuit comprising two rams, and a pair of changeover valves and load sense system, to control the rams.

FIG. 27 is an example of a circuit demonstrating hydraulic load sensing with flow control. FIG. 27 shows a synthetically commutated machine 100, a machine controller 128, a prime mover 150, a three position solenoid valve 'change-over valve' 183, load pressure feedback (hydraulic fluid line) 250, load holding valve 252, a shuttle valve 254, option i) flow meter signal 256, option i) flow meter location 258, option ii) flow meter signal 260, and option ii) flow meter location 262. The service displacement is set so that the output flow of the service is equal to the drain flow (measured by the flow meter 258) plus a margin, and the maximum load pressure is sensed and used to set the output pressure, or the excess flow is measured by a flowmeter 262 and minimised by the controller adjusting the service displacement. A further embodiment uses a pressure sensor $P_{out\,2}$ to provide a pressure demand signal to the controller 128, which is used to set the service displacement. In this embodiment the flowmeters 258, 262 are not required. As shown in FIG. 27, the sensing of the highest pressure of fluid in a pair of fluid lines connected to a single double acting load, may be performed by a shuttle valve, which diverts the highest pressure of the two lines to an outlet port. In the case of two loads, each with a shuttle valve 254, the two shuttle outlets are fed to a third shuttle valve, which in turn determines the highest pressure of the two flows to feedback to the pressure relief valve (PRV).

Figure 28:
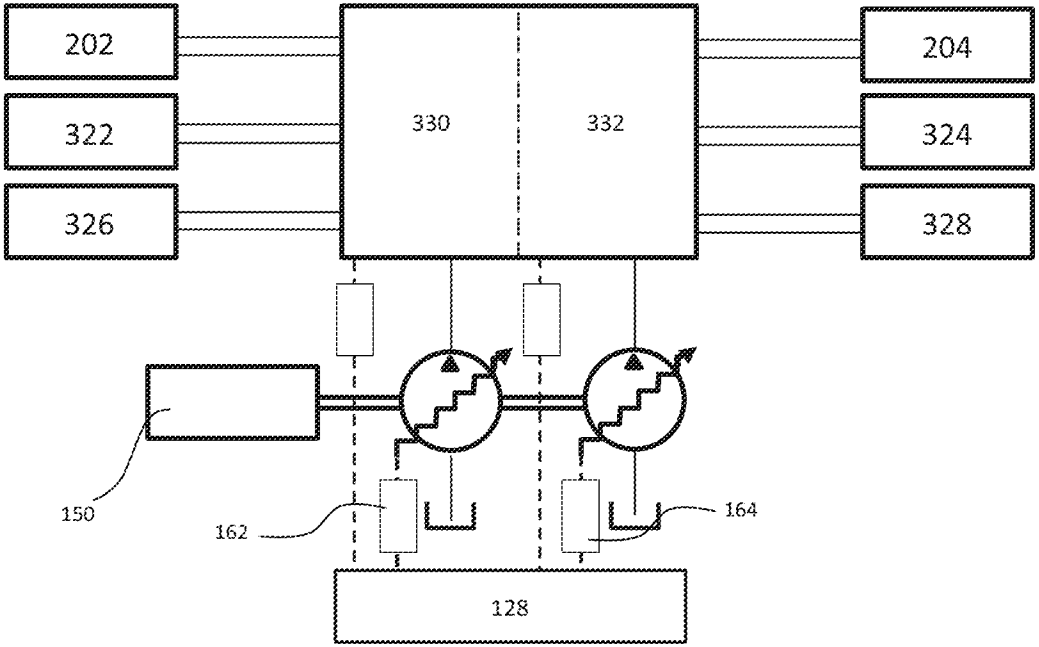
FIGS. 28 to 33 outline a variety of hydraulic circuits, which could be applied within an excavator, or other heavy construction equipment, comprising multiple loads, and multi-part valve block or multiple valve blocks.

FIG. 28 is similar to FIG. 21 in that the controller sees two load sense loads. Each load sense load is clearly assigned to a valve block part (A (330) or B (332)), and each of the two parts of the valve block are respectively connected to 3 of 6 function loads 202, 322, 326, and 204, 324, 328. The image shows 3 function loads connected to each, however the design may differ in respect of this distribution. FIG. 28 further shows a machine controller 128, a prime mover 150, a pump 1 displacement demand 162, and a pump 2 displacement demand 164.

Figure 29:
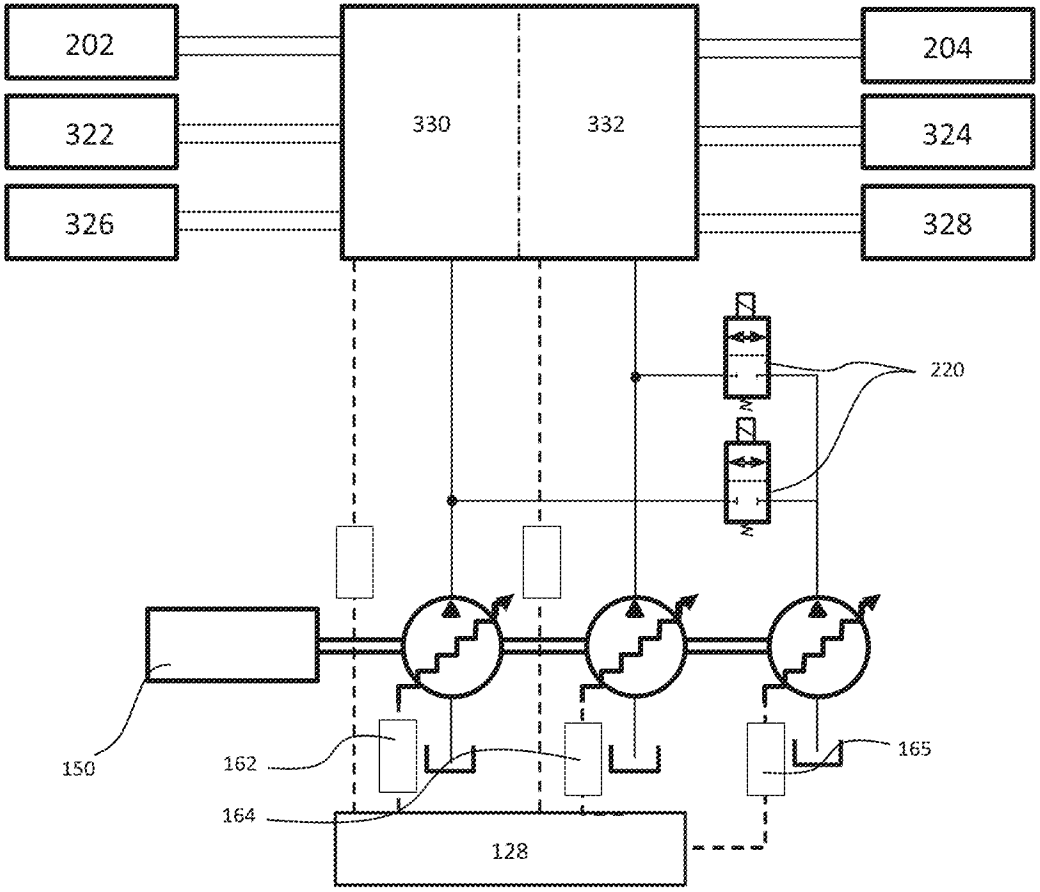

FIG. 29 features a roving service, and the same valve block arrangement and load sense assignment as FIG. 28. FIG. 29 further shows ganging valves 220.

Figure 30:
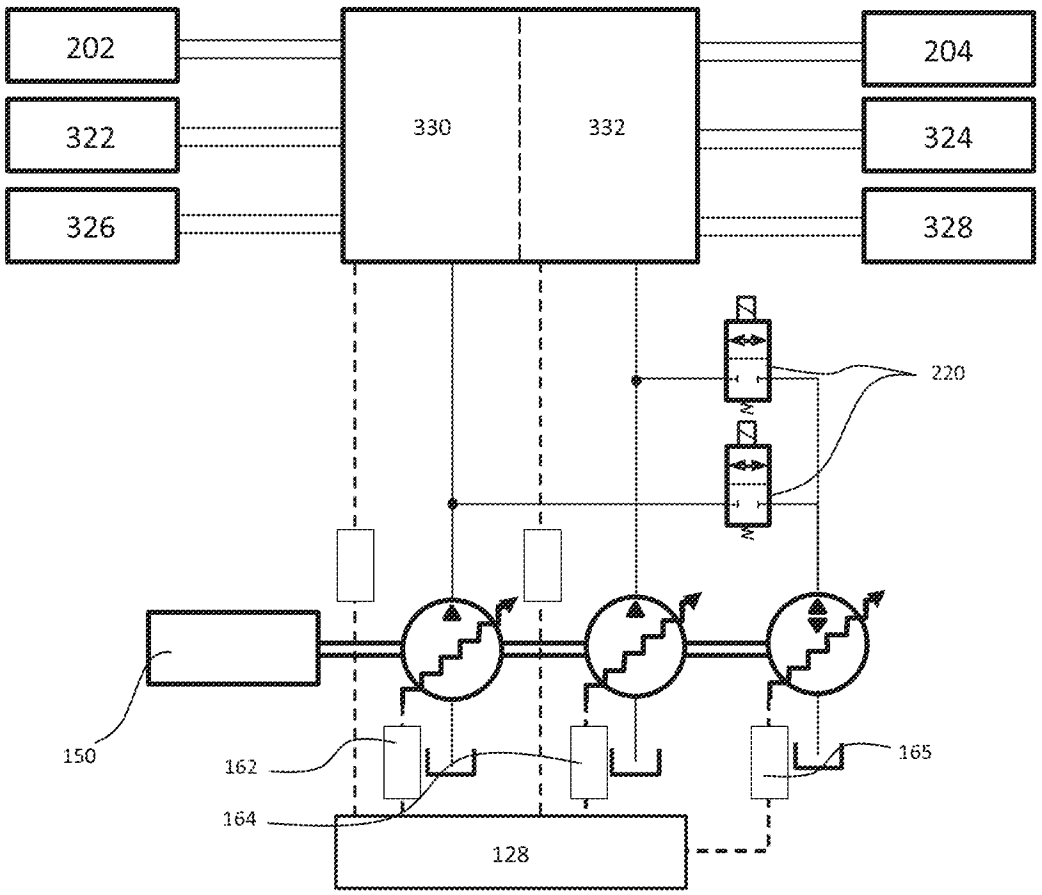

FIG. 30 features a roving pump-motor service, again with the same valve block arrangement and load sense assignment as FIG. 28. FIG. 30 further shows ganging valves 220, and a pump 3 displacement demand 165.

Figure 31:
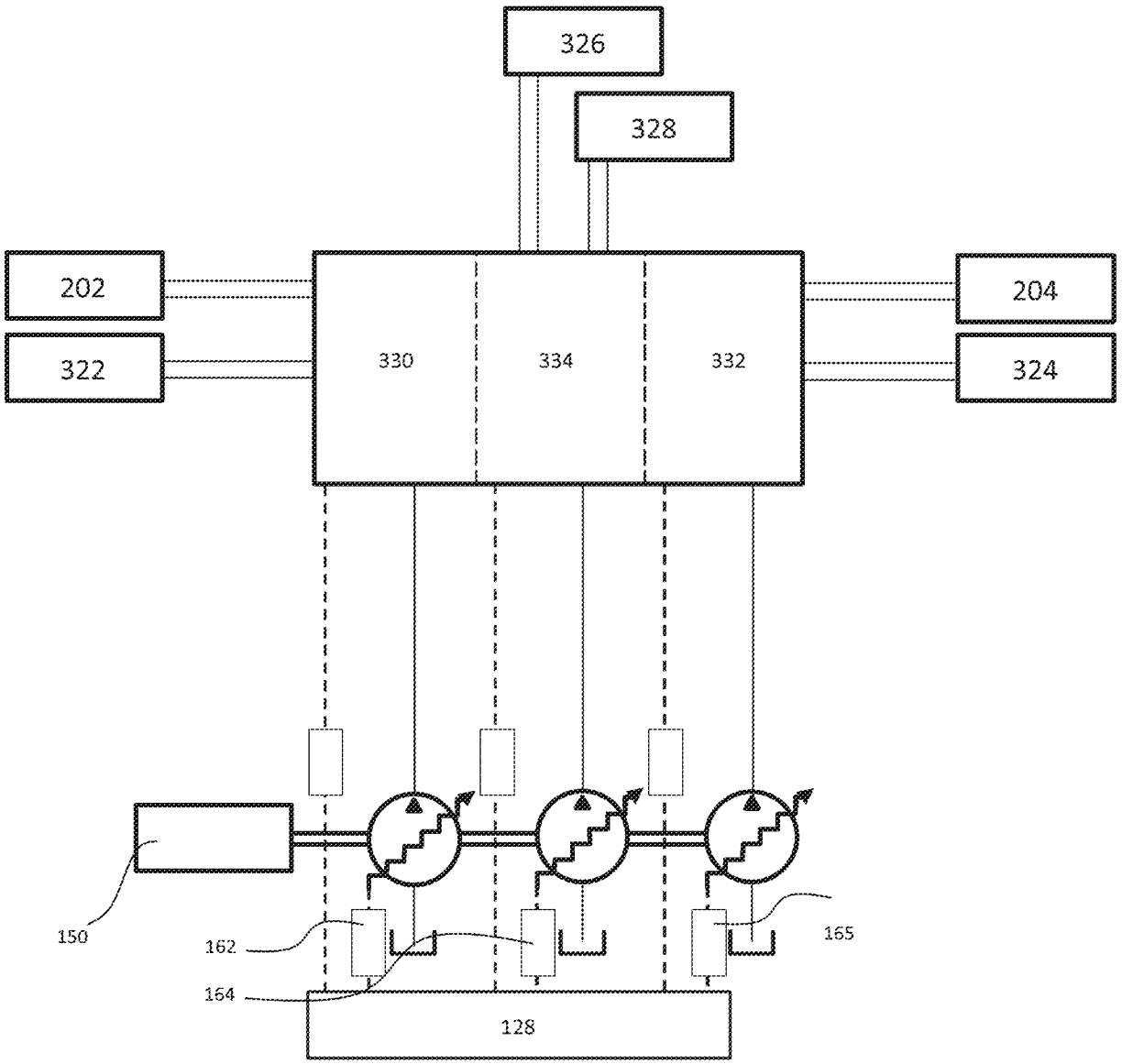

FIG. 31 is similar to FIG. 28, however an additional load sense load is added, and the valve block comprises an additional part (C) and thus the additional load sense load is assigned to the additional part (C) of the valve block. Correspondingly, the function loads are redistributed, the Figure illustrating 2 loads to each. An additional service is used to supply the additional part of the valve block. FIG. 31 further shows a pump 3 displacement demand 165.

Figure 32:
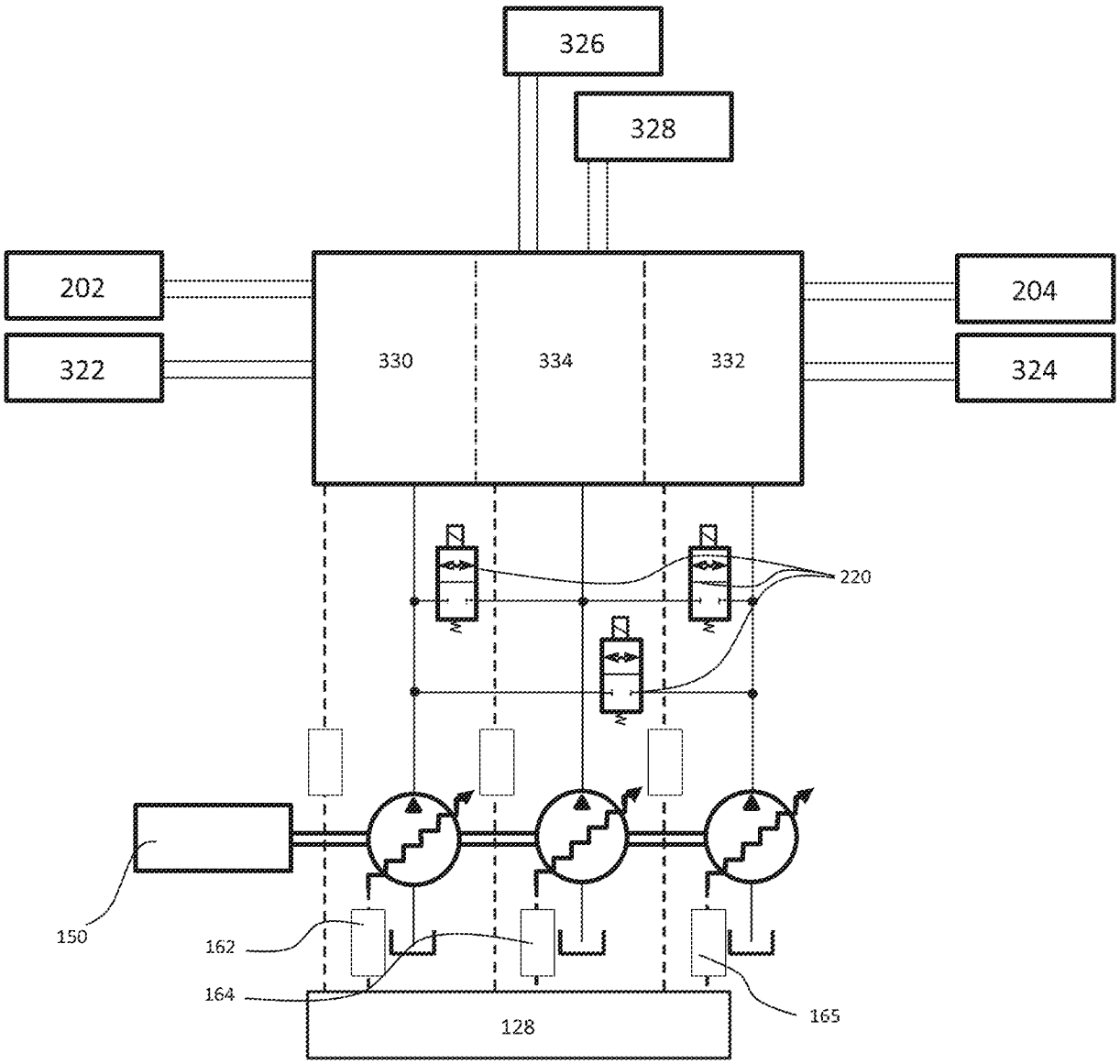

FIG. 32 is similar to FIG. 31 in respect of the 3 valve block parts and 3 load sense loads, and 6 function loads, and is similar to certain other previous Figures in showing ganging valves. As shown, the ganging valves allowing commoning of service 1&2, and/or 1&3 and/or 2&3. FIG. 32 further shows ganging valves 220.

Figure 33:
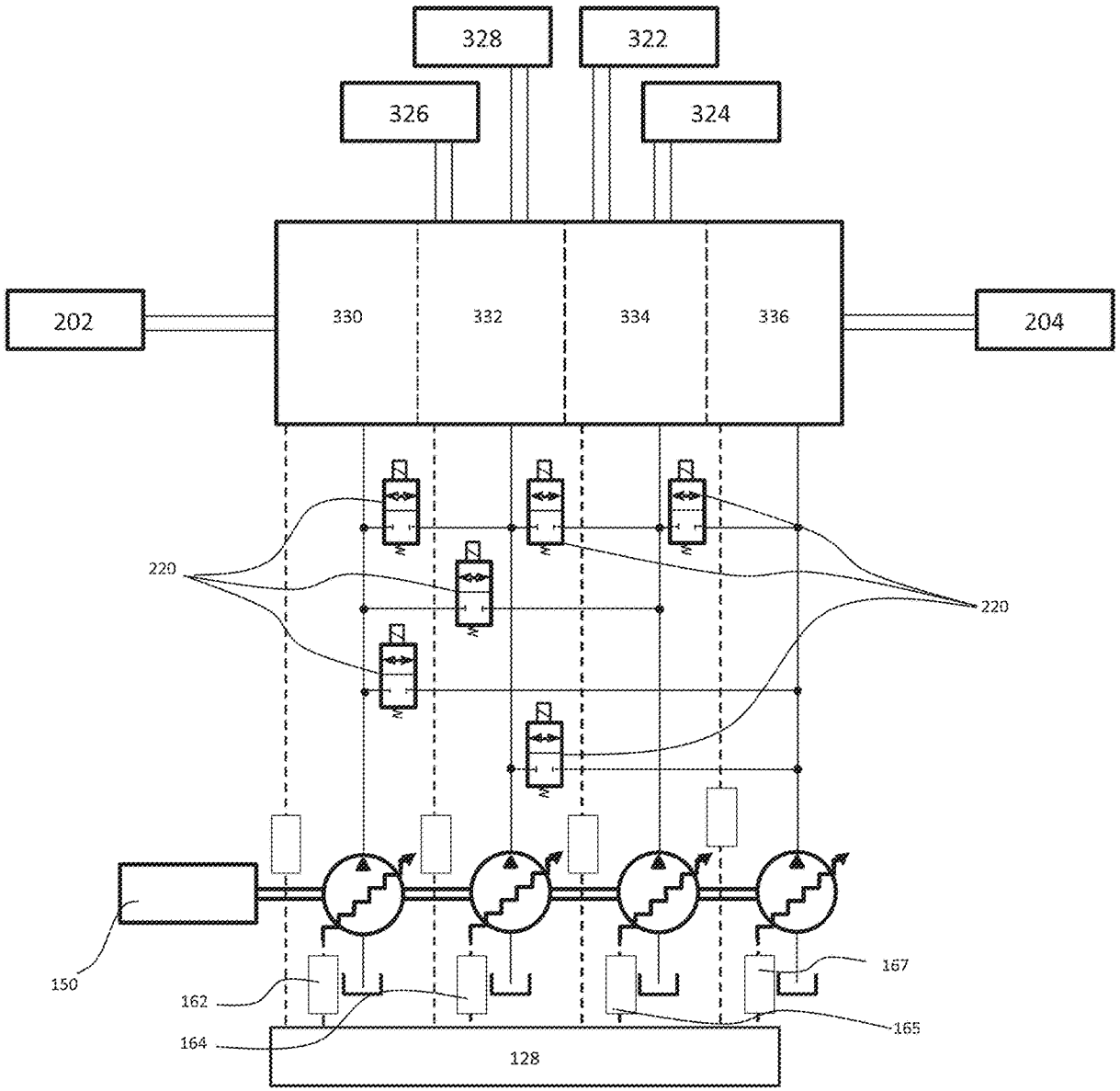

FIG. 33 is similar to FIG. 31, however a yet further additional load sense load is added, and the valve block comprises an additional part (D) (336) and thus the additional load sense load is assigned to the additional part (D) (336) of the valve block. Correspondingly, the function loads are redistributed, the Figure illustrating one function load to part A (330), two function loads respectively to parts C (334) & D (336), and one function load to part B (332).

An additional pumping service is added. Similar to FIG. 31, ganging valves 220 are added allowing commoning of services as can be seen and interpreted by one skilled in the art. FIG. 33 further shows a pump 4 displacement demand 167.

The invention claimed is:

1. An apparatus comprising a synthetically commutated machine with two or more services, the synthetically commutated machine comprising a rotatable shaft and a plurality of working chambers having a volume which varies cyclically with rotation of the rotatable shaft, each working chamber having low pressure and high pressure valves which regulate a flow of hydraulic fluid between the working chamber and low and high pressure lines, wherein at least the low pressure valves are electronically controlled valves, the apparatus comprising a controller which controls the electronically controlled valves in phased relationship with cycles of working chamber volume to thereby determine a net displacement of the hydraulic fluid by each working chamber on each cycle of working chamber volume, a prime mover coupled to the machine, a hydraulic circuit extending between the two or more services and a plurality of hydraulic loads to thereby fluidically connect the two or more services to the plurality of hydraulic loads such that groups of one or more services are fluidically connected to respective groups of one or more hydraulic loads, the apparatus configured such that the flow of the hydraulic fluid to or from a group of the groups of one or more services of the machine is controlled responsive to receiving a demand signal indicative of a demanded pressure or flow rate, wherein the pressure of and/or the flow rate of the hydraulic fluid accepted by, or output by each service is independently controllable, and the apparatus is configured to selectively connect an input or output of two or more of the services to thereby selectively increase an effective capacity of the services.

2. An apparatus according to claim 1, wherein the synthetically commutated machine is operable as a pump and wherein an output pressure of each of the groups of one or more services is controlled by sensing individual pressure requirements of the group of one or more hydraulic loads fluidically connected to the respective group of one or more services and controlling the flow of the hydraulic fluid out of the respective one or more services so that the output pressure exceeds by a margin a maximum demanded pressure of the one or more hydraulic loads fluidically connected thereto.

3. An apparatus according to claim 1, wherein the synthetically commutated machine is operable as a pump and wherein an output pressure of the group of one or more services of the machine is maintained at a set pressure based on a user selectable mode, with pressure feedback to a controller of the synthetically commutated machine which is operating in a closed loop pressure control mode, said controller of the synthetically commutated machine configured to set the flow rate of the hydraulic fluid by the group of one or more services to match a total demand for the flow of the hydraulic fluid by the group of one or more hydraulic loads connected to the one or more services, by sensing the output pressure of the group of the one or more services.

4. An apparatus according to claim 1, wherein an output flow of the group of one or more services of the machine is controlled by detecting a flow demand of all hydraulic loads fluidically connected to the respective one or more services.

5. An apparatus according to claim 1, further comprising another service, which is operable as a pump or a motor, which is configured to be selectively ganged with one or more other services to increase an effective capacity of said one or more other services, either boosting another pump service or boosting another motor service.

6. An apparatus according to claim 1, comprising a machine controller which controls the machine and optionally also one or more additional synthetically controlled machines driven by the same prime mover, wherein the machine controller is configured to calculate available power from the prime mover and to limit the net displacement of the hydraulic fluid by the one or more machines driven by the prime mover, such that a net power demand of the machines does not exceed that the available power from the prime mover, taking into account the measured pressure of each service of each machine, a known displacement of each service of each machine (whether outflow or inflow) and the known efficiency of pumping or motoring of each machine.

7. An apparatus according to claim 1, configured to implement a maximum rate of the flow of the hydraulic fluid through or pressure at the group of one or more services such that another group of one or more services and the group of one or more hydraulic loads fluidically connected to said another group of one or more services, are prioritised over one or more other hydraulic loads without exceeding a total available power or selectable maximum power of the machine.

8. An apparatus according to claim 1, wherein the group of one or more services of the machine is in fluidic communication with the group of one or more loads and also at least one drain with a flow meter configured to measure the flow rate of the hydraulic fluid to the drain, and wherein (a) the flow rate of hydraulic fluid output by the group of one or more services is controlled to exceed the measured flow rate of the hydraulic fluid from that group of loads to the drain, or (b) the flow rate of hydraulic fluid out of the group of one or more services is controlled responsive to the measured flow rate of the hydraulic fluid to minimize the flow of the hydraulic fluid to the drain.

9. An apparatus according to claim 1, wherein a synthetically commutated machine controller controls the prime mover with reference to an engine map to thereby increase energy efficiency with which demands of the hydraulic loads for pressure and flow of hydraulic fluid are met, or to thereby reduce an average or maximum operating speed of the prime mover.

10. An apparatus according to claim 1, wherein, when a prime mover power limit is reached, or it is predicted that the prime mover power limit is reached, the apparatus is configured to control an additional power source, other than the prime mover, to obtain additional energy from the additional power source to drive the synthetically commutated machine.

11. An apparatus according to claim 1, wherein the controller is configured to selectively cause the flow of the hydraulic fluid to the group of one or more hydraulic loads from a hydraulic fluid store, to selectively cause the hydraulic liquid from the group of one or more hydraulic loads to flow to said hydraulic fluid store for later use, and to adjust a displacement of the machine such that a sensed pressure or flow demand of the group of one or more hydraulic loads is met a. wholly by the flow of the hydraulic fluid from the hydraulic fluid store, or b. by a combination of the flow of hydraulic fluid from the hydraulic fluid store and the group of one or more services of the machine which are fluidically connected to the group of one or more hydraulic loads, or c. wholly by the group of one or more services of the machine which are fluidically connected to the group of one or more hydraulic loads and, in the case where the flow to a hydraulic load is supplied wholly or partly from the hydraulic fluid store, the controller is configured to control the prime mover to limit a power output of the prime mover.

12. An apparatus according to claim 1, comprising a hydraulic fluid store and configured to selectively introduce hydraulic liquid from the hydraulic fluid store to the group of one or more services or the group of one or more hydraulic loads, to thereby drive the machine or the group of one or more hydraulic loads, and to selectively receive the hydraulic liquid from the group of one or more services the group of one or more hydraulic loads into the hydraulic fluid store, and further to receive the hydraulic fluid from the hydraulic fluid store to a first group of one or more services while a second group of one or more different services outputs the hydraulic fluid to the group of one or more hydraulic loads.

13. An apparatus according to claim 1, comprising at least a further synthetically commutated machine coupled to the first said synthetically commutated machine, wherein the synthetically commutated machine is coupled to one or more sources of the hydraulic fluid through one or more services and the further synthetically commutated machine is coupled to a hydraulic fluid store such that receipt of the hydraulic fluid from the one or more sources by the synthetically commutated machine causes the further synthetically commutated machine to pump the hydraulic fluid into the hydraulic fluid store and/or receipt of the hydraulic fluid by the further synthetically commutated machine from the hydraulic fluid store causes the synthetically commutated machine to pump the hydraulic fluid through the one or more services.

14. An apparatus according to claim 1, configured to selectively charge an energy storage device using energy from the flow of the hydraulic fluid into the group of one or more services from the group of one or more hydraulic loads and to selectively pump hydraulic fluid from the group of one or more services to the group of one or more hydraulic loads from the energy storage device.

15. An apparatus according to claim 1, wherein at least one hydraulic load is connected either directly to said group of one or more services, with no additional flow control mechanism between the group of one or more services and the hydraulic load, or connected via a flow smoothing device only, such that a mean hydraulic flow rate to or from the group of one or more services is directly proportional to a displacement velocity of a displaceable member of the hydraulic load, and where the flow to or from the service is controlled responsive to a signal indicating a demanded velocity of displacement of the displaceable member.

16. An apparatus according to claim 1, wherein the group of one or more services is fluidically connected to a hydraulic load of the plurality of hydraulic loads, the hydraulic load comprising an actuator having a displaceable member which is displaced in use in dependence on the flow of the hydraulic fluid with no additional flow control mechanism between the group of one or more services and the hydraulic load, except optionally a flow smoothing device, such that a volume of the hydraulic fluid flowing from the group of one or more services to the hydraulic load or vice versa is directly proportional to the displacement of the displaceable member, and where the volume of the hydraulic fluid flowing from the group of one or more services to the hydraulic load or vice versa is controlled responsive to a signal indicating a demanded displacement of the displaceable member and/or a signal indicating the measured displacement of the displaceable member.

17. A method of operating the apparatus according to claim 1, comprising:

detecting the flow and/or pressure requirement of at least one of the groups of one or more hydraulic loads, or receiving a demand signal indicative of a demanded pressure or flow based on a pressure and/or flow demand of the group of one or more hydraulic loads, and controlling the flow of the hydraulic fluid from or to each of the group of one or more services which is fluidically connected to the group of one or more hydraulic loads, responsive thereto.

18. An apparatus according to claim 1, wherein the group of one or more services is fluidically connected to a hydraulic load of the plurality of hydraulic loads, the hydraulic load comprising an actuator having a displaceable member which is displaced in use in dependence on the flow of the hydraulic fluid with no additional flow control mechanism between the group of one or more services and the hydraulic load, such that a volume of the hydraulic fluid flowing from the group of one or more services to the hydraulic load or vice versa is directly proportional to the displacement of the displaceable member, and where the volume of the hydraulic fluid flowing from the group of one or more services to the hydraulic load or vice versa is controlled responsive to a signal indicating a demanded displacement of the displaceable member and/or a signal indicating the measured displacement of the displaceable member.

* * * * *